US010670983B2

(12) United States Patent
Taguchi et al.

(10) Patent No.: US 10,670,983 B2
(45) Date of Patent: Jun. 2, 2020

(54) TONER SET, WHITE TONER, AND ELECTROSTATIC CHARGE IMAGE DEVELOPER

(71) Applicant: FUJI XEROX CO., LTD., Tokyo (JP)

(72) Inventors: Tetsuya Taguchi, Kanagawa (JP); Tomoaki Tanaka, Kanagawa (JP); Shinya Sakamoto, Kanagawa (JP); Ryutaro Kembo, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/587,493

(22) Filed: May 5, 2017

(65) Prior Publication Data

US 2018/0164709 A1 Jun. 14, 2018

(30) Foreign Application Priority Data

Dec. 8, 2016 (JP) ..... 2016-238296

(51) Int. Cl.

| | |
|---|---|
| ***G03G 9/09*** | (2006.01) |
| ***G03G 9/08*** | (2006.01) |
| ***G03G 9/087*** | (2006.01) |
| ***G03G 9/097*** | (2006.01) |
| ***G03G 15/00*** | (2006.01) |

(52) U.S. Cl.

CPC ..... *G03G 9/0902* (2013.01); *G03G 9/0804* (2013.01); *G03G 9/0819* (2013.01); *G03G 9/0827* (2013.01); *G03G 9/08755* (2013.01); *G03G 9/08795* (2013.01); *G03G 9/08797* (2013.01); *G03G 15/6585* (2013.01)

(58) Field of Classification Search

CPC .... G03G 9/0902; G03G 9/0804; G03G 9/092; G03G 9/0918; G03G 9/0827; G03G 9/0819; G03G 15/0806; G03G 9/08755

See application file for complete search history.

(56) References Cited

U.S. PATENT DOCUMENTS

| | | | | |
|---|---|---|---|---|
| 6,416,918 | B2 * | 7/2002 | Matsumura | G03G 9/0804 430/110.4 |
| 8,465,895 | B2 | 6/2013 | Ikeda et al. | |
| 8,989,631 | B2 | 3/2015 | Yamashita et al. | |
| 9,091,971 | B2 | 7/2015 | Takahashi et al. | |

(Continued)

FOREIGN PATENT DOCUMENTS

| | | |
|---|---|---|
| JP | 61-117566 A | 6/1986 |
| JP | 64-48067 A | 2/1989 |

(Continued)

*Primary Examiner* — Thorl Chea

(74) *Attorney, Agent, or Firm* — Sughrue Mion, PLLC

(57) ABSTRACT

A toner set includes a white toner that includes white toner particles containing white colored particles, and at least one selected from a color toner that includes color toner particles containing colored particles and a transparent toner that includes transparent toner particles, wherein an average circularity of the white toner particles is smaller than an average circularity of either the color toner particles or the transparent toner particles and a small-diameter-side number particle diameter distribution index of the white toner particles is greater than a small-diameter-side number particle diameter distribution index of either the color toner particles or the transparent toner particles.

14 Claims, 3 Drawing Sheets

(56) References Cited

U.S. PATENT DOCUMENTS

| | | | | |
|---|---|---|---|---|
| 2011/0136051 | A1* | 6/2011 | Ishii | G03G 9/0812<br>430/105 |
| 2012/0148948 | A1* | 6/2012 | Ikeda | G03G 9/09708<br>430/108.3 |
| 2013/0195508 | A1* | 8/2013 | Shigezaki | G03G 15/0806<br>399/223 |
| 2015/0362872 | A1* | 12/2015 | Kawamura | G03G 15/6585<br>430/105 |
| 2016/0054669 | A1* | 2/2016 | Hori | G03G 9/0827<br>399/223 |

FOREIGN PATENT DOCUMENTS

| | | | |
|---|---|---|---|
| JP | 2007-33719 | A | 2/2007 |
| JP | 2012-128008 | A | 7/2012 |
| JP | 2014-228554 | A | 12/2014 |
| JP | 2015-1628 | A | 1/2015 |

* cited by examiner

TONER SET, WHITE TONER, AND ELECTROSTATIC CHARGE IMAGE DEVELOPER

CROSS-REFERENCE TO RELATED APPLICATIONS

This application is based on and claims priority under 35 USC 119 from Japanese Patent Application No. 2016-238296, filed Dec. 8, 2016.

BACKGROUND

1. Technical Field

The present invention relates to a toner set, a developer set, a white toner, and an electrostatic charge image developer.

2. Related Art

In recent years, an electrophotographic process has been widely used not only in a copying machine but also in an office network printer, a PC printer, a printer for on-demand printing, and the like regardless of monochrome printing or color printing, and there has been increasing requirements for performances such as high quality, an increase in speed, high reliability, reduction in size, a reduction in weight, and energy saving due to development in devices in an information society and enhancement in communication networks.

In the electrophotographic process, a fixed image is typically formed through plural processes of electrically forming an electrostatic charge image on a photoreceptor (image holding member) having a photoconductive material by various means, developing the electrostatic charge image by using a developer containing a toner, transferring a toner image on the photoreceptor onto a recording medium such as a paper via an intermediate transfer member or directly, and then fixing the image transferred on the recording medium.

SUMMARY

According to an aspect of the invention, there is provided a toner set including:

a white toner that includes white toner particles containing white colored particles; and at least one selected from a color toner that includes color toner particles containing colored particles and a transparent toner that includes transparent toner particles, wherein an average circularity of the white toner particles is smaller than an average circularity of either the color toner particles or the transparent toner particles, and wherein a small-diameter-side number particle diameter distribution index of the white toner particles is greater than a small-diameter-side number particle diameter distribution index of either the color toner particles or the transparent toner particles.

BRIEF DESCRIPTION OF THE DRAWINGS

Exemplary embodiments of the present invention will be described in detail based on the following figures, wherein.

DETAILED DESCRIPTION

Figure 1:
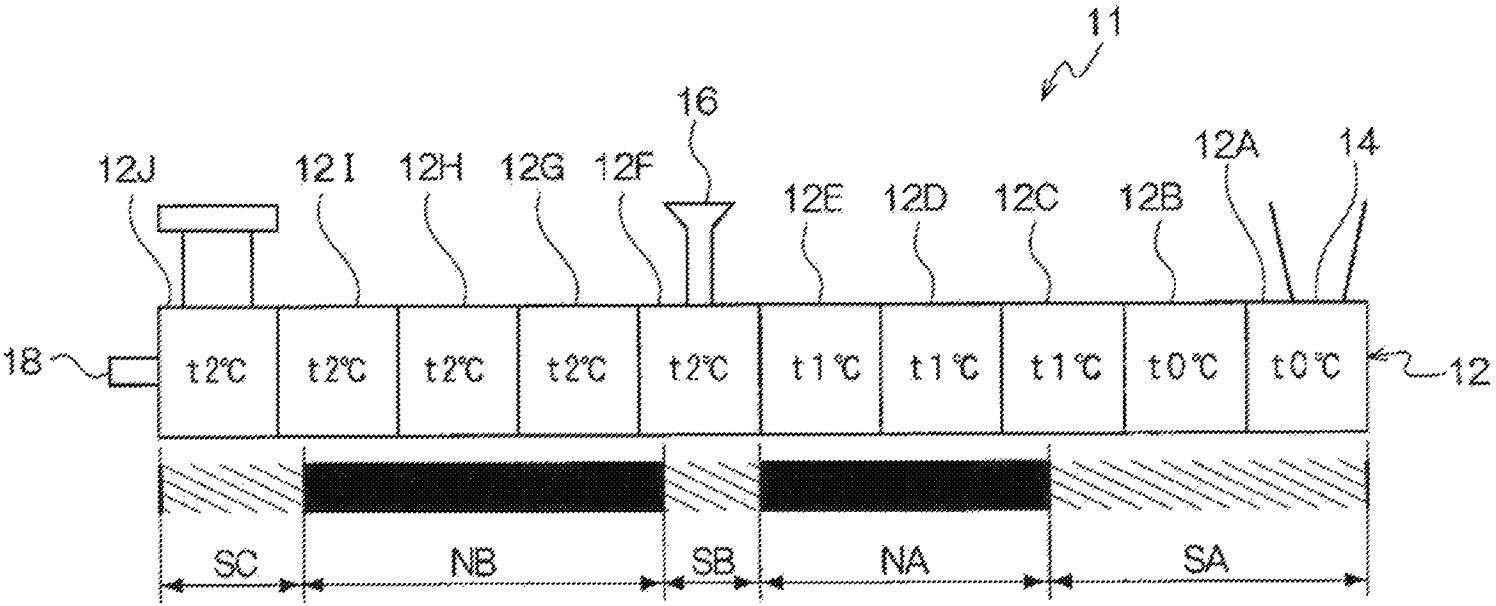
FIG. 1 is a diagram illustrating a state of a screw in one example of a screw extruder that is used for preparing a toner according to an exemplary embodiment.

Hereinafter, embodiments of a toner set, a developer set, a toner cartridge set, a white toner, an electrostatic charge image developer, a toner cartridge, a process cartridge, an image forming apparatus, and an image forming method according to an exemplary embodiment of the invention will be described in detail.

White Toner

A white toner according to an exemplary embodiment includes white toner particles containing white colored particles, and a number average particle diameter of the white colored particles is from 200 nm to 400 nm, and a proportion of the white colored particles having a particle diameter of 350 nm to 600 nm with respect to the entire white colored particles is from 5% by number and to 50% by number.

For the white toner, a pigment with a high refractive index such as titanium oxide, zinc oxide, lead oxide, and hollow particles is used as the white colored particles in many cases. A white toner image reproduces a white color and exhibits a hiding property due to incident light deflected from an observed surface of a toner image by the white colored particles and returned to the observed surface. In order to achieve high whiteness and a hiding property, the particle diameters of the white colored particles contained in the white toner are greater than the particle diameters of the colored particles contained in the color toner, and the content thereof is greater than that of the colored particles contained in the color toner.

Therefore, a filler effect of the white colored particles makes it difficult to melt or soften the white toner, and the white toners are not easily made to adhere to each other in an initial stage of fixation. In a case where a white image is formed on a thick recording medium such as a thick paper or a thick film, a nipping pressure at the time of the fixation increases due to the thickness of the recording medium itself, and pressure energy to be applied to the white toner before melting and fixing thus increases. As a result, if the fixing pressure is applied to the white toner that has been insufficiently deformed due to melting, the white toner image is disturbed, and the white toner is scattered in some cases. Such a phenomenon tends to occur in a line image, and particularly significantly appears at a high speed machine (an image forming apparatus with a process speed of equal to or greater than 280 mm/sec, for example).

The inventors has discovered as a result of intensive studies that the scattering of the white toner is able to be prevented while securing the hiding property by setting the number average particle diameter of the white colored particles used in the white toner to be from 200 nm to 400 nm and setting the proportion of the white colored particles having a particle diameter of 350 nm to 600 nm with respect to the entire white colored particles to be from 5% by number to 50% by number. The reason may be presumed as follows though not apparent.

Since the white colored particles having a particle diameter of 350 nm to 600 nm in the white colored particles having a number average particle diameter of 200 nm to 400 nm are particles having a larger particle diameter among white colored particles used in the white toner, unevenness and protrusions are easily formed on the surface of the white toner. By forming the unevenness on the surface of the white toner, the number of contact points of the white toner in an unfixed white toner image increases. The white colored particles having a particle diameter of 350 nm to 600 nm, which are present at projection portions on the surface of the white toner exhibits high heat conductivity than that of binder resin included in the white toner while exhibiting a low filler function. Therefore, thermal energy from a fixing member is easily delivered, and the binder resin at and around the projection portions is easily melted or softened when the toner image is fixed. Therefore, it is expected that the white toners are made to adhere to each other rapidly in an initial stage of fixation and the scattering of the white toner is prevented.

Hereinafter, the white toner according to the exemplary embodiment will be described in detail.

The white toner according to the exemplary embodiment, includes white toner particles containing white colored particles. The white toner particles may include a binder resin, and if necessary, other additives such as a release agent, for example. The white toner according to the exemplary embodiment may include an external additive if necessary.

White Colored Particles

The white toner according to the exemplary embodiment contains white colored particles as a colorant.

Materials of the white colored particles used in the exemplary embodiment are not particularly limited. Examples thereof include inorganic pigments (titanium oxide, barium sulfate, lead oxide, zinc oxide, lead titanate, potassium titanate, barium titanate, strontium titanate, zirconia, antimony trioxide, white lead, zinc sulfide, and barium carbonate, for example) and organic pigments (polystyrene resin, urea formalin resin, polyacrylic resin, polystyrene/acrylic resin, polystyrene/butadiene resin, and alkyl bismelamine resin, for example).

Also, a pigment having a hollow structure may be used. Examples of the pigment having a hollow structure include hollow inorganic pigments (hollow silica, hollow titanium oxide, hollow calcium carbonate, hollow zinc oxide, and zinc oxide tube particles, for example), hollow organic particles (styrene resin, acrylic resin, styrene/acrylic resin, styrene/acrylic acid ester/acrylic acid resin, styrene/butadiene resin, styrene/methyl methacrylate/butadiene resin, ethylene/vinyl acetate resin, acrylic acid/vinyl acetate resin, and acrylic acid/maleic acid resin, for example).

Furthermore, examples thereof include heavy calcium carbonate, light calcium carbonate, aluminum hydroxide, satin white, talc, calcium sulfate, magnesium oxide, magnesium carbonate, amorphous silica, colloidal silica, white carbon, kaolin, calcined kaolin, delaminated kaolin, aluminosilicate, sericite, bentonite, and smectite.

Among these examples, titanium oxide particles are preferably used as the white colored particles.

One kind of white colored particles may be used alone, or two or more kinds of white colored particles may be used in combination.

As the white colored particles, surface-treated white colored particles may be used as needed, and a dispersant may be used together.

The content of the white colored particles is preferably from 10 parts by weight to 50 parts by weight with respect to 100 parts by weight, of the white toner particles, for example. If the content of the white colored particles is equal to or greater than 10 parts by weight, sufficient whiteness and a hiding property may be easily exhibited. Moreover, if the content of the white colored particles is equal to or less than 50 parts by weight, interfaces between the white colored particles and the binder resin do not unnecessarily increase, the white toner image is thus not easily destroyed, and an effect of preventing destruction of the image tends to be improved.

The content of the white colored particles is preferably from 20 parts by weight to 50 parts by weight, and more preferably from 25 parts by weight to 45 parts by weight with respect to 100 parts by weight of the white toner particles.

The number average particle diameter of the white colored particles is set to be from 200 nm to 400 nm. If the number average particle diameter of the white colored particles is from 200 nm to 400 nm, high whiteness and a hiding property are exhibited. The number average particle diameter of the white colored particles is preferably from 250 nm to 400 nm, and more preferably from 250 nm to 350 nm.

A proportion of the white colored particles having a particle diameter of 350 nm to 600 nm with respect to the entire white colored particles is set to be from 5% by number to 50% by number. If the proportion of the white colored particles having a particle diameter of 350 nm to 600 nm is from 5% by number to 50% by number, an excellent hiding property is achieved, and scattering of the toner is further prevented. If the proportion of the white colored particles having a particle diameter of 350 nm to 600 nm is equal to or less than 50% by number, crack does not easily occur in a fixing member, and irregularity in gloss does not easily occur in the toner image when a single-color image of the white toner is formed.

The proportion of the white colored particles having a particle diameter of 350 nm to 600 nm is preferably from 5% by number to 40% by number, and more preferably from 10% by number to 30% by number.

The particle diameter distribution of the white colored particles in the white toner particles is calculated as follows, for example.

The white toner according to the exemplary embodiment is solidified by being mixed with epoxy resin, embedded, and kept over night, and then a thin piece having a thickness of from about 250 nm to about 450 nm is prepared by using an ultramicrotome device (Ultracut UCT, manufactured by Leica).

The obtained thin piece is observed with an ultrahigh resolution field emission scanning electron microscope (S-4800, manufactured by Hitachi-High Technologies Corporation), and the white colored particles inside the white toner particles are checked. In a case where contours of the white colored particles are not obvious, the observation may be performed again by adjusting the thickness of the thin piece to be observed. In a case where there are a large number of blank defects inside the white toner particles, there is a possibility that the white colored particles have fallen off at the time of preparing the thin piece. Therefore, the thickness of the thin piece is preferably adjusted to be thicker. In a case where it is difficult to distinguish contours of the white colored particles since many of the white colored particles inside the white toner particles are viewed in an overlaid manner, it is preferable to adjust the thickness of the thin piece to be thinner since there is a possibility that plural white colored particles are observed in an overlaid manner due to an excessively thick thickness of the thin piece.

An observed photograph is converted into an electronic form and is imported into image analysis software (Win ROOF) manufactured by Mitani Corporation, and the number average particle diameter of the white colored particles in the white toner particles and the proportion of the white colored particles having a particle diameter of 350 nm to 600 nm with respect to the entire white colored particles are obtained by the following procedure, for example.

That is, a toner sectional region in an embedding agent is selected as a selection target, "automatic binarization-discriminant analysis method" of a "binarization processing" command is used to perform binarization processing, and the white colored particles and the binder resin part are separated from each other. At this time, it is confirmed whether or not the white colored particles are separated one by one at the white colored particle region part of the binary image by making a comparison with an image before the binarization. Plural particles successively binarized are corrected such that each one white colored particle forms each white colored particle region part by adjusting the threshold value for the binarization to independently binarize the particles one by one or manually dividing regions. An extracted white colored particle region is selected, a maximum feret diameter is obtained and regarded as the particle diameter of the white colored particles.

In a case where it is not possible to normally perform the binarization due to photograph capturing desnsity or noise, the image may be sharpened by "filter-median" processing or edge extraction processing, and then a boundary may be manually set.

For calculating the number average particle diameter of the white colored particles, an image in which about 10 to 100 pigment particles are viewed in one field of view is used to obtain a measurement values of 300 or more white colored particles, and an arithmetic average value thereof is used. Furthermore, for calculating the proportion of the white colored particles having a particle diameter of 350 nm to 600 run with respect to the entire white colored particles, the total number of measured particles and the number of the white colored particles having a particle diameter of 350 nm to 600 nm are counted, and the value obtained by calculating "the number of white colored particles having a particle diameter of 350 nm to 600 nm"/"the total number of measured particles"×100 is assumed to be the proportion of the white colored particles having a particle diameter of 350 nm to 600 nm with respect to the entire white colored particles.

In a case of calculating the number average particle diameter of the white colored particles and the proportion of the white colored particles having a particle diameter of 350 nm to 600 nm with respect to the entire white colored particles only for the white colored particles, the calculation may be made by performing image analysis in the same manner as described above, for example, by using an electronic image obtained by slightly mixing the white colored particles with 100 μm of zirconia particles and observing the white colored particles that adhere to the surfaces of the zirconia particles with an electron microscope (for example, S-4800 manufactured by Hitachi-High Technologies Corporation). If the white colored particles are in an aggregate state at this time, the white colored particles are manually divided into regions to correct the regions such that each one white colored particle forms each white colored particle region part. Also, an image is prepared in advance by causing the white colored particles to adhere to a conductive tape and observing the white colored particles with the electron microscope, shapes of the white colored particles to be observed are compared, and the white colored particles crushed and deformed at the time of mixing with the zirconia particles are excluded from the target of measurement.

In a case where it is difficult to observe the white colored particles since the white colored particles on the surfaces of the zirconia particles are overlaid or aggregated, such a situation may be improved by adjusting the mixing condition, such as by reducing the ratio of the white colored particles to be mixed.

In a case where titanium oxide is used as the white colored particles, commercially available titanium oxide or synthesized titanium oxide may be used. In a case where commercially available titanium oxide is used, titanium oxide that exhibits the above properties may be obtained by appropriately mixing plural types of titanium oxide with different particle diameters and different particle diameter distributions.

In contrast, in a case where titanium oxide is synthesized, the synthesis method is not particularly limited. For example, glycerin is added to an aqueous titanium tetrachloride solution, and the resultant is heated and filtered. The obtained white powder is dispersed in ion-exchanged water, hydrochloric acid is added thereto, and the resultant is heated again. The pH is adjusted to 7 with sodium hydroxide, the resultant is filtered, washed with water, and dried to obtain hydrous titanium dioxide particles. Then, $Al_2O_3$, $K_2O$, and $P_2O_5$ are mixed with the hydrous titanium dioxide particles, and the resultant is burned, thereby obtaining titanium oxide particles.

In a case of obtaining the titanium oxide particles by the method, it is possible to obtain the titanium oxide particles having different average particle diameters by changing the amount and a ratio of addition of $Al_2O_3$, $K_2O$, and $P_2O_5$ added to obtain the titanium oxide particles and the calcination temperature. It is possible to arbitrarily adjust the average particle diameter and the particle diameter distribution of the titanium oxide particles by mixing the titanium oxide particles having different average particle diameters. Also, it is possible to obtain the titanium oxide particles having wide particle diameter distribution by loosening mixing conditions when $Al_2O_3$, $K_2O$, and $P_2O_5$ are mixed (obtaining partially non-uniform state). If the amount of the phosphate compound ($P_2O_5$) increases, the particle diameters of the titanium oxide particles tend to decrease. If the amount of the potassium compound ($K_2O$) increases, the particle diameters of the titanium oxide particles tend to increase. If the calcination temperature becomes higher, the particle diameters of the titanium oxide particles tend to increase.

Binder Resin

Examples of the binder resin include vinyl resin composed of a homopolymer such as styrenes (such as styrene, parachlorostyrene, or α-methylstyrene), (meth) acrylic acid esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), ethylenic unsaturated nitriles (such as acrylonitrile, or methacrylonitrile), vinyl ethers (such as vinyl methyl ether, or vinyl isobutyl ether), vinyl ketones (vinyl methyl ketone, vinyl ethyl ketone, or vinyl isopropenyl ketone), or olefins (such as ethylene, propylene, or butadiene) and a copolymer of two or more kinds of monomers for the above homopolymers.

Examples of the binder resin also include non-vinyl resin such as epoxy resin, polyester resin, polyurethane resin, polyamide resin, cellulose resin, polyether resin, or modified rosin, a mixture of such non-vinyl resin and the above vinyl resin, and graft polymer obtained by polymerizing vinyl monomer in presence of the non-vinyl monomer.

One kind or two or more kinds of such binder resin may be used alone or in combination.

Polyester resin is preferably used as the binder resin.

Examples of polyester resin include known amorphous polyester resin. As the polyester resin, crystalline polyester resin may be used along with amorphous polyester resin.

"Crystalline" resin represents that there is a clear endothermic peak rather than a change in the endothermic energy amount in a stepwise manner in the differential scanning calorimetry (DSC), and specifically represents that a half width of the endothermic peak is within 10° C. when measurement is performed at a temperature increasing speed of 10 (° C./min).

In contrast, "amorphous" resin represents that the half width is greater than 10° C., that a change in the endothermic energy amount in the stepwise manner is exhibited, or that no clear endothermic peak is observed.

Amorphous Polyester Resin

Examples of amorphous polyester resin include condensation polymer of polyvalent carboxylic acid and polyvalent alcohol. A commercially available amorphous polyester resin or synthesized amorphous polyester resin may be used.

Examples of polyvalent carboxylic acid include aliphatic dicarboxylic acid (such as oxalic acid, malonic acid, maleic acid, fumaric acid, citraconic acid, itaconic acid, glut a conic acid, succinic acid, alkenyl succinate, adipic acid, or sebacic acid), alicyclic dicarboxylic acid (such as cyclohexane dicarboxylic acid), aromatic dicarboxylic acid (such as terephthalic acid, isophthalic acid, phtalic acid, or naphthalenedicarboxylic acid), anhydride thereof, or lower alkyl ester (containing from 1 to 5 carbon atoms, for example) thereof. Among the examples, aromatic dicarboxylic acid, for example, is preferably used as polyvalent carboxylic acid.

As polyvalent carboxylic acid, trivalent or higher carboxylic acid with a crosslinked structure or a branched structure may be used with dicarboxylic acid. Examples of trivalent or higher carboxylic acid include trimellitic acid, pyromellitic acid, anhydride thereof, or lower alkyl ester (containing from 1 to 5 carbon atoms, for example) thereof.

One kind or two or more kinds of polyvalent carboxylic acid may be used alone or in combination.

Examples of polyvalent alcohol include aliphatic diol (such as ethylene glycol, diethylene glycol, triethylene glycol, propylene glycol, butanediol, nexanediol, or neopentyl glycol), alicyclic diol (such as cyclohexanediol, cyclohexanedimethanol, hydrogenated bisphenol A), and aromatic diol (such as ethylene oxide adduct of bisphenol A or propylene oxide adduct of bisphenol A). Among the examples, aromatic diol, alicyclic diol are preferably used, and aromatic diol is more preferably used as polyvalent alcohol.

As polyvalent alcohol, trivalent or higher polyvalent alcohol having a crosslinked structure or a branched structure may be used with diol. Examples of trivalent or higher polyvalent alcohol include glycerine, trimethylol propane, and pentaerythritol.

One kind or two or more kinds of polyvalent alcohol may be used alone or in combination.

The glass transition temperature (Tg) of amorphous polyester resin is preferably from 50° C. to 80° C., and more preferably from 50° C. to 65° C.

The glass transition temperature is determined by a DSC curve obtained by a differential scanning calorimetry (DSC). More specifically, the glass transition temperature is determined based on "Extrapolation glass transition onset temperature" described in how to determine glass transition temperature in JIS K 7121-1987 "Testing methods for transition temperatures of plastics".

The weight average molecular weight (Mw) of amorphous polyester resin is preferably from 5,000 to 1,000,000, and more preferably from 7,000 to 500,000.

The number average molecular weight (Mn) of amorphous polyester resin is preferably from 2,000 to 100,000.

The molecular weight distribution Mw/Mn of amorphous polyester resin is preferably from 1.5 to 100, and more preferably from 2 to 60.

The weight average molecular weight and the number average molecular weight are measured by gel permeation choromatography (GPC). The molecular weight measurement by the GPC is performed by using GPC-HLC-8120GPC manufactured by Tosoh Corporation as a measurement apparatus, a column TSKgel SUPERHM-M (15 cm) manufactured by Tosoh Corporation, and THE solvent. The weight average molecular weight and the number average molecular weight are calculated by using a molecular weight calibration curve provided by a mono-dispersed polystyrene standard sample based on the measurement result.

The amorphous polyester resin is obtained by a known preparing method. Specifically, the polyester resin is obtained by a method of setting a polymerization temperature to be from 180° C. to 230° C., for example, reducing a pressure in a reaction system as needed, and causing a reaction while removing water and alcohol that are generated during condensation.

In a case in which monomer of the raw materials are not dissolved or blended at the reaction temperature, a solvent having a high boiling temperature may be added as a solubilizer to promote the dissolution. In such a case, the polycondensation reaction is performed while distillating the solubilizer. In a case in which monomer having low compatibility is present in the copolymerization reaction, it is preferable to condense the monomer having low compatibility and acid or alcohol to be polycondensed with the monomer in advance and then cause polycondensation with main components.

Here, as the polyester resin, modified polyester resin is also exemplified in addition to the unmodified polyester resin. The modified polyester resin is polyester resin in which a linking group other than ester bond is present or polyester resin in which resin components that are different from polyester resin components are bonded by covalent bond, ion bond, or the like. Examples of modified polyester include resin obtained by causing a reaction between polyester resin to which a functional group such as an isocyanate group that reacts with an acid group or a hydroxyl group is terminally introduced and an active hydrogen compound and modifying the terminal.

As the modified polyester resin, urea-modified polyester resin is preferably used from the viewpoint of heat-resistant storage stability.

As the urea-modified polyester resin, one kind of amorphous resin is used in many case though it depends on a type, a blending quantity, and the like of monomer used.

As the urea-modified polyester resin, urea-modified polyester resin obtained by a reaction (at least one of a crosslinking reaction and an elongation reaction) between polyester resin with isocyanate groups (polyester prepolymer)

and an amine compound is preferably used. The urea-modified polyester may contain urethane bond along with urea bond.

Examples of the polyester prepolymer with isocyanate groups includes prepolymer obtained by causing polyester that is a polycondensate between polyvalent carboxylic acid and polyvalent alcohol and has active hydrogen to react with a polyvalent isocyanate compound. Examples of a group with active hydrogen contained in polyester includes a hydroxyl group (an alcoholic hydroxyl group and a phenolic hydroxyl group), an amino group, a carboxyl group, and a mercapto group, and alcoholic hydroxyl group is preferably used.

In the polyester prepolymer having isocyanate groups, examples of polyvalent carboxylic acid and polyvalent alcohol used include the same compounds as those of the polyvalent carboxylic acid and polyvalent alcohol described above in the section for the amorphous polyester resin.

Examples of the polyvalent isocyanate compound include aliphatic polyisocyanate (such as tetramethylene diisocyanate, hexamethylene diisocyanate, and 2,6-diisocyanate methyl caproate); alicyclic polyisocyanate (such as isophorone diisocyanate and cyclohexylmethane diisocyanate); aromatic diisocyanate (tolylene diisocyanate and diphenylmethane diisocyanate); aromatic-aliphatic diisocyanate (such as α,α,α',α'-tetramethylxylylene diisocyanate); isocyanurates; and materials obtained by blocking polyisocyanate with a blocking agent such as a phenol derivative, oxime, or caprolactam.

One kind of the polyvalent isocyanate compound may be used alone, or two or more kinds of the polyvalent isocyanate compounds may be used in combination.

As for the ratio of the polyvalent isocyanate compound, an equivalent ratio [NCO]/[OH] between the isocyanate group [NCO] and the hydroxyl group [OH] in the polyester prepolymer having a hydroxyl group is preferably from 1/1 to 5/1, more preferably from 1.2/1 to 4/1, and further preferably from 1.5/1 to 2.5/1. [NCO]/[OH] is preferably from 1/1 to 5/1 from the viewpoint of heat-resistant storage stability. If [NCO]/[OH] is equal to or less than 5/1, deterioration of a low-temperature fixing property may be easily prevented.

The content of a component derived from the polyvalent isocyanate compound in the polyester prepolymer having a isocyanate group is preferably from 0.5% by weight to 40% by weight, more preferably from 1% by weight to 30% by weight, and further preferably from 2% by weight to 20% by weight with respect to the entire polyester prepolymer having an isocyanate group. The content of the component derived from the polyvalent isocyanate is preferably from 0.5% by weight to 40% by weight from the viewpoint of glossiness in images. If the content of the component derived from the polyvalent isocyanate is equal to or less than 40% by weight, a deterioration in the low-temperature fixing property may be easily prevented.

The average number of isocyanate groups contained in one molecule of the polyester prepolymer having an isocyanate group is preferably equal to or greater than 1, more preferably from 1.5 to 3, and further preferably from 1.8 to 2.5. The number of isocyanate groups is preferably equal to or greater than 1 per molecule from the viewpoint of charging stability.

Examples of the amine compound that reacts with the polyester prepolymer having an isocyanate group include diamine, trivalent or higher polyamine, amino alcohol, amino mercaptan, amino acid, and compounds obtained by blocking amino groups thereof.

Examples of diamine include aromatic diamine (such as phenylenediamine, diethyltoluenediamine, and 4,4'-diaminodiphenylmethane); alicyclic diamine (4,4'-diamino-3,3'-dimethyldicyclohexylmethane, cyclohexanediamine, and isophoronediamine); and aliphatic diamine (ethylenediamine, tetramethylenediamine, and hexamethylene diamine).

Examples of trivalent or higher polyamine include diethylenetriamine, and triethylenetetramine.

Examples of amino alcohol include ethanol amine and hydroxyethylaniline.

Examples of amino mercaptan include aminoethyl mercaptan and aminopropyl mercaptan.

Examples of amino acid include aminopropionic acid and aminocaproic acid.

Examples of the compounds obtained by blocking amino groups thereof include ketimine compounds obtained from amine compounds such as diamine, trivalent or higher polyamine, amino alcohol, amino mercaptan, and amino acid and ketone compounds (such as acetone, methyl ethyl ketone, and methyl isobutyl ketone) and oxazoline compounds.

Among these amine compounds, ketimine compounds are preferably used.

One kind of amine compound may be used alone, or two or more kinds of amine compounds may be used in combination.

The urea-modified polyester resin may be resin having an adjusted molecular weight after reaction by adjusting the reaction (at least one of a crosslinking reaction and an elongation reaction) between the polyester resin having an isocyanate groups (polyester prepolymer) and the amine compound with a terminator that stops at least one of the crosslinking reaction and the elongation reaction (hereinafter, also referred to as a "crosslinking/elongation reaction terminator").

Examples of the crosslinking/elongation reaction terminator include monoamine (diethylamine, dibutylamine, butylamine, and laurylamine) and materials obtained by blocking them (ketimine compounds).

As for the ratio of the amine compound, the equivalent ratio [NCO]/[NHx] between an isocyanate group [NCO] in the polyester prepolymer having an isocyanate group and an amino group [NHx] in the amine is preferably from 1/2 to 2/1, more preferably from 1/1.5 to 1.5/1, and further preferably from 1/1.2 fto 1.2/1. The ratio [NCO]/[NHx] is preferably set within the above range from the viewpoint of heat-resistant storage stability.

The glass transition temperature of the urea-modified polyester resin is preferably from 40° C. to 65° C., and more preferably from 45° C. to 60° C. The number average molecular weight is preferably from 2,500 to 50,000, and more preferably from 2,500 to 30,000. The weight average molecular weight is preferably from 10,000 to 500,000, and more preferably from 30,000 to 100,000.

Crystalline Polyester Resin

Examples of the crystalline polyester resin include a polycondensate of polyvalent carboxylic acid and polyvalent alcohol. Commercially available crystalline polyester resin may be used, or synthesized crystalline polyester resin may be used.

Here, the crystalline polyester resin is preferably a polycondensate using a polymerizable monomer with a linear aliphatic compound rather than a polymerizable monomer with an aromatic compound in order to facilitate formation of a crystal structure.

Examples of the polyvalent carboxylic acid include aliphatic dicarboxylic acid (such as oxalic acid, succinic acid, glutaric acid, adipic acid, suberic acid, azelaic acid, sebacic acid, 1,9-nonanedicarboxylic: acid, 1,10-decanedicarboxylic acid, 1,12-dodecariedicarboxylic acid, 1,14-tetradecanedicarboxylic acid, and 1,18-octadecanedicarboxylic acid), aromatic dicarboxylic acid (dibasic acid such as phthalic acid, isophthalic acid, terephthalic: acid, and naphthalene-2,6-dicarboxylic acid), anhydrides thereof, and lower (containing 1 to 5 carbon atoms, for example) alkyl esters thereof.

As the polyvalent carboxylic acid, trivalent or higher carboxylic acid with a crosslinked structure or a branched structure may be used with the dicarboxylic acid. Examples of trivalent carboxylic acid include aromatic carboxylic acid (such as 1,2,3-benzenetricarboxylic acid, 1,2,4-benzenetricarboxylic acid, and 1,2,4-naphthalenetricarboxylic acid), anhydrides thereof, and lower alkyl esters thereof (the alkyl group containing 1 to 5 carbon atoms, for example).

As the polyvalent carboxylic acid, dicarboxylic acid with a sulfonic acid group or dicarboxylic acid with ethylenic double bond may be used with the dicarboxylic acid.

One kind of polyvalent carboxylic acid may be used alone, or two or more kinds of polyvalent carboxylic acids may be used in combination.

Examples of the polyvalent alcohol include aliphatic diol (for example, linear aliphatic diol containing 7 to 20 carbon atoms at a main chain). Examples of aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, and 1,18-octadecanediol, 1,14-eicosanedecanediol. Among these examples, 1,8-octanediol, 1,9-nonanediol, and 1,10-decanediol are preferably used as the aliphatic diol.

As the polyvalent alcohol, a trivalent or higher alcohol having a cross linking structure or a branched structure may be used with a diol. Examples of the trivalent or higher trimethylolpropane, and pentaerythritol.

One kind of polyvalent alcohol may be used alone, or two or more kinds of polyvalent alcohols may be used in combination, Here, the content of aliphatic diol in polyvalent alcohol may be preferably equal to or greater than 80 mol %, and preferably equal to or greater than 90 mol %.

The melting temperature of crystalline polyester resin is preferably from 50° C. to 100° C., more preferably from 55° C. to 90° C., and further preferably from 60° C. to 85° C.

The melting temperature is obtained as a "melting peak temperature" described in a method of obtaining a melting temperature in JIS K7121-1987 "Testing methods for transition temperatures of plastics" from a DSC curve obtained by differential scanning calorimetry (DSC).

The weight average molecular weight (Mw) of the crystalline polyester resin is preferably from 6,000 to 35,000.

The crystalline polyester resin, as well as the amorphous polyester resin, is obtained by a known preparing method.

The content of the binder resin is preferably from 40% by weight to 95% by weight, more preferably from 50% by weight to 90% by weight, and further preferably from 60% by weight to 85% by weight with respect to the entire white toner particles, for example.

In a case where amorphous polyester resin and crystalline polyester resin are used together as the binder resin, the content of the crystalline polyester resin is preferably from 5% by weight to 50% by weight, more preferably from 5% by weight to 40% by weight, and further preferably from 10% by weight to 25% by weight with respect to the entire white toner particles.

If the content of the crystalline polyester resin is from 5% by weight to 50% by weight with respect to the entire white toner particles, it is possible to improve adhesiveness of the white toner particles and to thereby further prevent the scattering of the white toner.

Release Agent

Examples of the release agent include hydrocarbon wax; natural wax such as carnauba wax, rice wax, or candelilla wax; synthesized, mineral, or petroleum wax such as montan wax; and ester wax such as fatty acid ester or montanic acid ester. The release agent is not limited thereto.

The melting temperature of the release agent is preferably from 50° C. to 110° C., and more preferably from 60° C. to 100° C.

The melting temperature is obtained based on "melting peak temperature" described in how to obtain a melting temperature in JIS K 7121-1987 "Testing methods for transition temperatures of plastics" from a DSC curve obtained by a differential scanning calorimetry (DSC).

The content of the release agent is preferably from 1% by weight to 20% by weight, and more preferably from 5% by weight to 15% by weight with respect to the entire white toner particles, for example.

Other Additives

Examples of other additives include known additives such as a magnetic material, a charge-controlling agent, and inorganic powder. Such additives are contained in the white toner particles as an internal additive.

Properties of White Toner Particles

The white toner particles may be toner particles having a single-layer structure or may be toner particles having a so-called core shell structure formed of a core (core particle) and a covering layer (shell layer) covering the core.

Here, each white toner particle having the core shell structure preferably includes, for example, a core that contains the binder resin, white colored particles, and if necessary, other additives such as a release agent, and a covering layer that contains the binder resin.

The volume average particle diameter (D50v) of the white toner particles is preferably from 3 μm to 12 μm, and more preferably from 4 μm to 10 μm.

Various average particle diameters and various particle diameter distribution indexes of the toner particles are measured by a COULTER MULTISIZER II (manufactured by Beckman Coulter) and ISOTON-II (manufactured by Beckman Coulter) as an electrolyte.

For measurement, 0.5 mg to 50 mg of a measurement sample is added to 2 ml of 5% aqueous solution of a surfactant (preferably sodium alkylbenzene sulfonate) as a dispersant. This is added to 100 ml or more and 150 ml or less of electrolyte.

The electrolyte in which the sample is suspended is subjected to dispersion processing for 1 minute by an ultrasonic disperser, and particle diameter distribution of particles having particle diameters falling within a range of 2 μm to 60 μm is measured by using an aperture having an aperture diameter of 100 μm by a COULTER MULTISIZER II. The number of particles to be sampled is 50,000.

When cumulative distribution of volumes and numbers with respect to particle diameter ranges (channels) divided based on the measured particle diameter distribution are depicted, respectively, from the smaller diameter side, a particle diameter corresponding to an accumulation of 16% is defined as a number particle diameter D16p, a particle diameter corresponding to an accumulation of 50% is defined as a number particle diameter D50p (number average particle diameter) and a volume particle diameter D50v (volume average particle diameter), and a particle diameter corresponding to an accumulation of 84% is defined as a number particle diameter D84p.

By using these, volume particle diameter distribution index (GSDv) is calculated as $(D84v/D16v)^{1/2}$, and the number particule diameter distribution index (GSDp) is calculated as $(D84p/D16p)^{1/2}$.

Furthermore, a small-diameter-side number particle diameter distribution index (lower GSDp) is calculated as (D50p/D16p).

The lower GSDp of the white toner particles is preferably from 1.25 to 1.35, more preferably from 1.25 to 1.33, and further preferably from 1.25 to 1.30. If the lower GSDp of the white toner particles is from 1.25 to 1.35, the scattering of the toner when the toner image is fixed is further prevented.

The average circularity of the white toner particles is preferably from 0.955 to 0.969, more preferably from 0.958 to 0.969, and further preferably from 0.960 to 0.967. If the average circularity of the white toner particle is from 0.955 to 0.969, the scattering of the toner when the toner image is fixed is further prevented.

The average circularity (D16p average circularity) of the white toner particles having a particle diameter falling within the range of from 0.5 μm to a particle diameter corresponding to an accumulation of 16% by number from the small particle diameter side is preferably greater than the average circularity of the entire white toner particles, and the ratio (D16p average circularity/average circularity of the entire white toner particles) is more preferably from 0.960 to 0.975, and further preferably from 0.962 to 0.969.

If the D16p average circularity of the white toner particles is greater than the average circularity of the entire white toner particles, the scattering of the toner when the toner image is fixed is further prevented.

Specifically, the average circularity of the entire toner particles and the D16p average circularity are measured as follows, for example.

A measurement solution is prepared by adding a measurement sample to a 5% by weight of aqueous solution of a surfactant (sodium dodecylbenzenesulfonate) as a dispersant and dispersing the measurement sample with an ultrasonic disperser. 5,000 or more particles are measured in an HPF mode (high resolution mode) with a measurement apparatus FPIA3000 (manufactured by Sysmex). The measurement result is analyzed within a range from 0.5 μm to 100 μm, and a number average calculated from circularity of all the particles as targets of the analysis is regarded as the average circularity of the entire toner particles. Also, the number average of circularity of particles in a case where the analysis range is limited to particles with particle diameters falling within a range of from 0.5 μm to a particle diameter corresponding to an accumulation of 16% by number from the small particle diameter side is regarded as D16p average circularity. In a case where an image photograph of the measured particles is checked at the time of the analysis and materials that are different from the toner particles, such as foreign matters or air bubbles, are included, the analysis is performed by excluding the materials.

The circularity is calculated as follows.

$$\text{Circularity}=\text{equivalent circle diameter circumferential length of observed particle/circumferential length of observed particle}=[2\times(A\times\pi)^{1/2}]/PM$$

Here, A represents a projection area of the observed particle, and PM represents a circumferential length of the observed particle.

In a case where the toner includes an external additive, the toner (developer) as a measurement target is dispersed in water containing a surfactant, ultrasonic processing is then performed thereon, and toner particles from which the external additive is removed are obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

It is preferable that the surfaces of the inorganic particles as the external additive are treated with a hydrophobizing agent. The treatment with the hydrophobizing agent is performed by dipping the inorganic particles in a hydrophobizing agent, for example. Although the hydrophobizing agent is not particularly limited, examples thereof include a silane coupling agent, silicone oil, a titanate coupling agent, and an aluminum coupling agent. One kind or two or more kinds of the hydrophobizing agents may be used alone or in combination.

The amount of the hydrophobizing agent is typically from 1 part by weight to 10 parts by weight with respect to 100 parts by weight of the inorganic particles, for example.

Examples of the external additive also include resin particles (resin particles of polystyrene, polymethyl methacrylate (PMMA), melamine resin, or the like) and a cleaning aid (metal salt of higher fatty acid, representative examples of which include zinc stearate, particles of fluorine high-molecular-weight material, or higher alcohols).

The amount of the external additive is preferably from 0.01% by weight to 5% by weight, and more preferably from 0.01% by weight to 2.0% bv weight with respect to the amount, of the white toner particles, for example.

Toner Set

The toner set according to the exemplary embodiment includes a white toner that includes white toner particles containing white colored particles, and at least one kind selected from a color toner that includes color toner particles containing colored particles and a transparent toner that includes transparent toner particles, average circularity of the white toner particles is smaller than average circularity of either the color toner particles or the transparent toner particles, and lower GSDp of the white toner particles is greater than lower GSDp of either the color toner particles or the transparent toner particles.

In the related art, there is a case where color reproductivity of a color toner or glossiness stability of a transparent toner deteriorates when a toner image in which a white toner and at least one kind selected from the color toner and the transparent toner are overlaid is formed on a thick recording medium such as a coat paper or an OHP film.

The reason that the color reproductivity of the color toner or the glossiness stability of the transparent toner deteriorates is presumed as follows.

Since the recording medium is thick in addition to the high height of the unfixed toner image if the unfixed toner image is formed by arranging the white toner on the lower side (on the side of the recording medium) and the at least one kind selected from the color toner and the transparent toner on the upper side (the side of the surface of the toner image) on the thick recording medium, pressure applied from the fixing member to the unfixed toner image when the unfixed toner image is fixed becomes higher than that for an ordinary toner image. Furthermore, since the at least one kind selected from the color toner and the transparent toner is present between the white toner and the fixing member, the white toner does not easily receive thermal energy. Moreover, since the white toner contains a larger amount of colored particles (white colored particles) than those in the color toner or the transparent toner, melting or softening does not easily occur due to the filler effect of the colored particles, and the white toner does not easily adhere to each other in the initial stage of fixation. As a result, the state under the high pressure is maintained for a longer period of time before the toner particles are melted and coalesced during the fixation when the toner image in which the white toner and the at least one kind selected from the color toner and the transparent toner are overlaid is fixed as compared with a combination color toner image with no white toner. If the white toner that has insufficiently been deformed due to the melting receives high fixing pressure, arrangement of the toner in the white toner image is disturbed. Therefore, the white toner is mixed with the color toner image or the transparent toner image.

The white toner exhibits whiteness by deflection of light as described above unlike an ordinary color toner. Therefore, if the fixation is performed in the state where the color toner and the white toner are mixed with each other, the white toner that is present on the upper side (on the side of the surface of the toner image) than the color toner prevents color development of the color toner on the lower side (the side of the recording medium). In order to improve the color development of the color toner in the toner image in which the white toner and the color toner are overlaid, it is necessary to prevent the mixing of the toner particles at the interface between the color toner and the white toner.

In a case where the white toner is scattered to the outside of the range of the toner image in which the white toner and the color toner are overlaid, the amount of the white toner that is supposed to be present under the color toner partially decreases. Therefore, the color developing property of the color toner thereon becomes different from that of the other part. Such a phenomenon tends to occur at an end of a solid image, in particular. In order to improve color uniformity in the toner image in which the white toner and the color toner are overlaid, it is necessary to prevent the mixing of the white toner particles and the color toner in the initial stage of fixation.

In contrast, it is important for the transparent toner to be present on the side of the surface of the toner image in order to cause the gloss in the toner image by using the transparent toner. Therefore, if the fixation is performed in the state where the white toner and the transparent toner are mixed with each other, the gloss of the toner image is damaged by the white toner that is present on the upper side (the side of the surface of the toner image) than the transparent toner. In order to improve the gloss of the toner image in which the white toner and the transparent toner are overlaid, it is necessary to prevent the mixing of the toner particles at the interface between the transparent toner and the white toner.

The above problems are solved by setting the average circularity of the white toner particles to be smaller than the average circularity of either the color toner particles or the transparent toner particles and setting the lower GSDp of the white toner particles to be greater than the lower GSDp of either the color toner particles or the transparent toner particles. The state that the lower GSDp of the white toner particles is greater than the lower GSDp of either the color toner particles or the transparent toner particles means that the white toner particles has wider particle diameter distribution toward the smaller diameter side than that of either the color toner particles or the transparent toner particles. Since the toner particles having smaller diameters have larger specific surface areas than the toner particles having the center particle diameter, easily receive thermal energy from the surfaces of the toner particles at the time of the fixation, and are easily warmed up to the inside of the toner particles, deformation due to melting of the toner particles tends to more quickly occur than the toner particles having the center particle diameter. Also, the toner particles having smaller diameters may fill clearances between the toner particles having larger diameters. Therefore, the white toner particles having smaller diameters on the lower side of the toner image, which are not easily deformed by the melting, are also rapidly melted. In contrast, since the white toner particles have the lower average circularity, unevenness is present on the surfaces of the white toner particles, and there are a large number of contact points between the white toner particles. Since a part of the unevenness on the surfaces of the white toner particles is more rapidly melted than the melting of the entire white toner particles at the time of the fixation, the contact points of the white toner particles are made to adhere. It is presumed that movement of the white toner particles is thus prevented and the mixing with the color toner particles and the transparent toner particles is reduced.

In a case where the lower GSDp of the color toner particles is equal to or greater than the lower GSDp of the white toner particles, the color toner particles having smaller diameters tend to enter clearances of the white toner particles. Furthermore, it is presumed that since the color toner particles having smaller diameters are easily melted when brought into contact with the fixing member due to large surface areas, and melting viscosity decreases, the melted color toner particles having smaller diameters soak into the clearances between the white toner and the white toner in the white toner image in an unmelted state, and the mixing between the color toner particles and the white toner particles tends to occur. It is presumed that the mixing between the transparent toner particles and the white toner particles tends to occur for the same reason.

It is presumed that in a case where the average circularity of the color toner particles is equal to or less than the average circularity of the white toner particles, a transferring property of the color toner particle deteriorates due to influences of the height of the toner image and the thickness of the recording medium when the color toner particles are transferred to the recording medium, transferring efficiency of the color toner particles thus deteriorates, the amount of the color toner particles to be shifted to the recording medium decreases, and color reproductivity deteriorates. It is presumed that the amount of the transparent toner particles decreases and glossiness stability deteriorates for the same reason.

Hereinafter, each toner that forms the toner set according to the exemplary embodiment will be described.

White Toner

A white toner that forms the toner set according to the exemplary embodiment is a toner that has a white color and is not particularly limited as long as the white toner satisfies relationships in which (1) the average circularity of white toner particles is smaller than the average circularity of either color toner particles or the transparent toner particles and (2) the lower GSDp of the white toner particles is greater than the lower GSDp of either the color toner particles or the transparent toner particles.

Since unevenness on the surface of the white toner increases and the color toner and the white toner are easily mixed with each other in a case where the average circularity of the white toner particles is less than 0.955 and a toner image in which the white toner and the color toner are overlaid with each other is formed, the average circularity of the white toner particles is preferably equal to or greater than 0.955.

The D16p average circularity of the white toner particles that form the white toner is preferably greater than the average circularity of the entire white toner particles. In this manner, it is possible to effectively remove deterioration of color reproductivity of the color toner and to improve color uniformity. That is, the D16p average circularity of the white toner particles that is greater than the average circularity of the entire white toner particles makes it possible to improve fluidity of small-diameter white toner particles and cause the small-diameter white toner particles to enter clearances between other white toner particles having larger diameters than the central diameters at the time of development or transferring. Therefore, it is possible to more efficiently promote adhesion between the white toner particles and to prevent mixing of the white toner particles and the color toner particles and scattering of the white toner particles when the small-diameter white toner particles are deformed due to melting at the time of fixation.

By setting the proportion of the white colored particles having a particle diameter of 350 nm to 600 nm with respect to the entire white colored particles included in the white toner particles to be from 5% by number to 50% by number, it is possible to further prevent mixing of the white toner particles and the color toner particles and scattering of the white toner particles. This is because the white colored particles having a particle diameter of 350 nm to 600 nm are particles having a larger particle diameter among the white colored particles used for the white toner, unevenness and protrusions are easily formed on the surfaces of the white toner particles, and the binder resin at and around the projection portions is easily melted or softened as mentioned above in the section of "white toner". Therefore, this is considered to be because adhesiveness between the white toner particles in the initial stage of fixation is more efficiently improved.

It is not preferable that the proportion of the white colored particles having a particle diameter of 350 nm to 600 nm with respect to the entire white colored particles be less than 5% by number since only the small effect of improving the mixture of the white toner particles and the color toner particles and the scattering of the white toner particles may be achieved.

In a case where amorphous polyester resin and crystalline polyester resin are used together as binder resin included in the white toner particles, the content of the crystalline polyester resin is preferably from 5% by weight to 50% by weight with respect to the entire toner particles from the viewpoint of preventing the mixing of the white toner particles and the color toner particles.

As described above, the white toner that forms the toner set according to the exemplary embodiment is preferably the white toner according to the exemplary embodiment.

Color Toner

Next, a color toner used in the exemplary embodiment will be described.

The color toner may be a known toner in the related art that contains a colorant, and the configuration thereof is not particularly limited.

Examples of the color toner includes known toners such as a magenta toner, a cyan toner, a yellow toner, a black toner, a red toner, a green toner, a blue toner, an orange toner, and a violet toner.

The color toner may have the same configuration except that the following colored particles are contained instead of the white colored particles used in the white toner according to the exemplary embodiment, for example. Also, the color toner may be prepared by the same preparing method as that for the white toner.

Colored Particles

Although a dye or a pigment may be employed as the colored particles used in the exemplary embodiment, a pigment is preferably used from the viewpoint of light fastness and water resistance. One kind of colored particles may be used alone, or two or more kinds of colored particles may be used in combination.

Examples of the colored particles that may be used in the exemplary embodiment include the following colored particles.

Examples of yellow colored particles include lead yellow, zinc yellow, yellow iron oxide, cadmium yellow, chrome yellow, hansa yellow, hansa yellow 10G, benzidine yellow G, benzidine yellow GR, threne yellow, quinoline yellow, and permanent yellow NCG.

Examples of blue colored particles include Prussian blue, cobalt blue, alkali blue lake, victoria blue lake, fast sky blue, indanthrene blue BC, aniline blue, ultramarine blue, calco oil blue, methylene blue chloride, phthalocyanine blue, phthalocyanine green, and malachite green oxalate.

Examples of red colored particles include bengal, cadmium red, red lead, mercury sulfide, watch young red, permanent red 4R, lithol red, brilliant carmine 3B, brilliant carmine 6B, Du Pont Oil red, pyrazolone red, rhodamine B lake, lake red C, rose bengal, eoxine red, and alizarin lake.

Examples of green colored particles include chromium oxide, chrome green, pigment green, malachite green lake, and final yellow green G.

Examples of orange colored particles include red chrome yellow, molybdenum orange, permanent orange GTR, pyrazolone orange, Vulcan orange, benzidine orange G, indanthrene brilliant orange RK, and indanthrene brilliant orange GK.

Examples of purple colored particles include manganese violet, fast violet B, and methyl violet lake.

Examples of black colored particles include carbon black, copper oxide, manganese dioxide, aniline black, activated carbon, non-magnetic ferrite, and magnetite.

The content of the colored particles in the color toner is preferably from 0.05% by weight to 12% by weight, and more preferably from 0.5% by weight to 8% by weight with respect to the binder resin.

The volume average particle diameter of the color toner is preferably from 2 μm to 12 μm, more preferably from 3 μm to 10 μm, and further preferably from 4 μm to 10 μm.

Transparent Toner

Next, a transparent toner used in the exemplary embodiment will be described.

The transparent toner may nave the same configuration as that of the white toner or the color toner except that total content of the white colored particles and the colored particles is equal to or less than 1% by weight, for example.

The volume average particle diameter of the transparent toner is preferably from 2 μm to 12 μm, more preferably from 3 μm to 10 μm, and further preferably from 4 μm to 10 μm.

In a case where the toner set has plural toners as the at least one kind selected from the color toner and the transparent toner, it is only necessary that the average circularity of the white toner particles is smaller than the average circularity of at least either the color toner particles or the transparent toner particles and that the lower GSDp of the white toner particles is greater than the lower GSDp of at least either the color toner particles or the transparent toner particles, and it is preferable that the average circularity of the white toner particles be smaller than the average circularity of both the color toner particles and the transparent toner particles and that the lower GSDp of the white toner particles be greater than the lower GSDp of both the color toner particles and the transparent toner particles.

In the exemplary embodiment, the ratio between the average circularity of the white toner particles and the average circularity of the at least either the color toner particles or the transparent toner particles (average circularity of white toner particles/average circularity of color toner particles or transparent toner particles) is preferably from 0.970 to 0.997, more preferably from 0.980 to 0.997, and further preferably from 0.980 to 0.990.

In the exemplary embodiment, the ratio between the lower GSDp of the white toner particles and the lower GSDp of the at least either the color toner particles and the transparent toner particles (lower GSDp of white toner particles/lower GSDp of color toner particles or transparent toner particles) is preferably from 1.03 to 1.30, more preferably from 1.03 to 1.25, and further preferably from 1.05 to 1.25.

In a case where the toner set includes plural toners as the at least one kind selected from the color toner and the transparent toner, it is more preferable that the white toner particles and all the color toner particles and the transparent toner particles satisfy the above relationships.

In order for the average circularity and the lower GSDp of the white toner particles, the color toner particles, and the transparent toner particles to satisfy the above relationships in the toner set according to the exemplary embodiment, a method of preparing toner particles having different particle diameters and particle shapes by an aggregation coalescence method or a kneading and pulverizing method, for example, and mixing the toner particles having different particle diameters and particle shapes so as to satisfy the above relationships is exemplified.

Preparing Method of Toner

Next, description will be given of a preparing method of the toner according to the exemplary embodiment.

The toner according to the exemplary embodiment is obtained by preparing the toner particles and then externally adding the external additive to the toner particles.

Although a preparing method of a white toner or a colored toner will be described below, a transparent toner may be prepared in the same manner other than white colored particles or other colored particles are not used.

The toner particles may be prepared by any of a dry preparing method (such as a kneading and pulverizing method) and a wet preparing method (such as an aggregating and coalescing method, a suspension polymerization method, or a dissolution suspension method). The preparing method of the toner particles is not particularly limited to these preparing methods, and a known preparing method is employed.

For example, the dissolution suspension method is a method of preparing and obtaining toner particles by dispersing, in an aqueous solvent containing a particle dispersion, a liquid obtained by dissolving or dispersing raw materials (such as binder resin and white colored particles or colored particles) that form toner particles in an organic solvent, in which the binder resin may be dissolved, and then removing the organic solvent.

The aggregation coalescence method is a method of obtaining toner particles through an aggregation process of forming aggregate of raw materials (such as resin particles and white colored particles or colored particles) that form the toner particles and a coalescence process of coalescing the aggregate.

Among these examples, the toner particles that contain the urea-modified polyester resin as the binder resin are preferably obtained by the dissolution suspension method described below. Although a method of obtaining toner particles that contain unmodified polyester resin and urea-modified polyester resin as binder resin will be described in the following description of the dissolution suspension method, the toner particles may contain only the urea-modified polyester resin as the binder resin.

[Oil-Phase Solution Preparation Process]

An oil-phase solution is prepared by dissolving or dispersing, in an organic solvent, toner particle materials that include an unmodified polyester resin, a polyester prepolymer having an isocyanate group, an amine compound, white colored particles or colored particles, and a release agent (oil-phase solution preparation process). The oil-phase solution preparation process is a process of obtaining a mixture solution of the toner materials by dissolving or dispersing the toner particle materials in the organic solvent.

For the oil-phase solution, 1) a preparing method of collectively dissolving or dispersing the toner materials in the organic solvent, 2) a preparing method of kneading the toner materials in advance and then dissolving or dispersing the kneaded material in the organic solvent, 3) a preparing method of dissolving the unmodified polyester resin, the polyester prepolymer having an isocyanate group, and the amine compound in the organic solvent and then dispersing the white colored particles or the colored particles and the release agent in the organic solvent, 4) a preparing method of dispersing the white colored particles or the colored particles and the release agent in the organic solvent and then dissolving the unmodified polyester resin, the polyester prepolymer having an isocyanate group, and the amine compound in the organic solvent, 5) a preparing method of dissolving or dispersing the toner particle materials (the unmodified polyester resin, the white colored particles or the colored particles, and the release agent) other than the polyester prepolymer having an isocyanate group and the amine compound in the organic solvent and then dissolving the polyester prepolymer having an isocyanate group and the amine compound in the organic solvent, 6) a preparing method of dissolving or dispersing the toner particle materials (unmodified polyester resin, the white colored particles or the colored particles, and the release agent) other than the polyester prepolymer having an isocyanate group or the amine compound in the organic solvent and then dissolving the polyester prepolymer having an isocyanate group or the amine compound in the organic solvent, and the like are exemplified. The preparing method of the oil-phase solution is not limited to these examples.

Examples of the organic solvent for the oil-phase solution include ester solvents such as methyl acetate and ethyl acetate; ketone solvents such as methyl ethyl ketone and methyl isopropyl ketone; aliphatic hydrocarbon solvents such as hexane and cyclohexane; and halogenated hydrocarbon solvents such as dichloromethane, chloroform, and trichloroethylene. These organic: solvents preferably dissolve binder resin, the rate at which the organic solvents are dissolved in water is preferably from about 0% by weight to about 30% by weight, and the boiling temperature thereof is preferably equal to or less than 100° C. Among these organic solvents, ethyl acetate is preferably used.

Suspension Preparation Process

Next, a suspension is prepared by dispersing the obtained oil-phase solution in a water-phase solution (suspension preparation process).

Then, a reaction between the polyester prepolymer having an isocyanate group and the amine compound is caused at the same time with the preparation of the suspension. Then, the urea-modified polyester resin is prepared by the reaction. The reaction is accompanied with at least one of a cross-linking reaction and an elongation reaction of a molecular chain. The reaction between the polyester prepolymer having an isocyanate group and the amine compound may be caused along with a solvent removing process which will be described later.

Here, reaction conditions are selected in accordance with reactivity between the isocyanate group structure included in the polyester prepolymer and the amine compound. In one example, the reaction time is preferably from 10 minutes to 40 hours and more preferably from 2 hours to 24 hours. The reaction temperature is preferably from 0° C. to 150° C., and more preferably from 40° C. to 98° C. For preparing the urea-modified polyester resin, a known catalyst, (dibutyltin laurate or dioctyltin laurate) may be used, if necessary. That is, a catalyst may be added to an oil-phase solution or a suspension.

Examples of the water-phase solution include a water-phase solution obtained by dispersing a particle dispersant such as an organic particle dispersant or an inorganic particle dispersant in an aqueous solvent. Examples of the water-phase solution also include a water-phase solution obtained by dispersing a particle dispersant in an aqueous solvent, and dissolving a polymer dispersant in an aqueous solvent. Known additives such as a surfactant may be added to the water-phase solution.

Examples of the aqueous solvent include water (for example, ion-exchanged water, distilled water, or pure water in general). The aqueous solvent may be a solvent that contains an organic solvent such as alcohol (methanol, isopropyl alcohol, or ethylene glycol), dimethylformamide, tetrahydrofuran, cellosolves (such as methylcellosolve), and lower ketones (such as acetone and methyl ethyl ketone) along with water.

Examples of the organic particle dispersant include a hydrophilic organic particle dispersant. Examples of the organic particle dispersant. Include particles of alkyl poly (meth)acrylic acid ester resin (for example, polymethyl methacrylate resin), polystyrene resin, and poly(styrene-acrylonitrile) resin. Examples of the organic particle dispersant also include particles of styrene acrylic resin.

Examples of the inorganic particle dispersant include a hydrophilic inorganic particle dispersant. Specific examples of the inorganic particle dispersant include particles of silica, alumina, titania, calcium carbonate, magnesium carbonate, tricalcium phosphate, clay, diatomaceous earth, and bentonite, and particles of calcium carbonate is preferably used. One kind of the inorganic particle dispersant may be used alone, or two or more kinds of the inorganic particle dispersants may be used in combination.

The surface of the particle dispersant may be treated with a polymer having a carboxyl group.

Examples of the polymer having a carboxyl group include copolymer of at least one kind selected from α,β-monoethylenic unsaturated carboxylic acid and salts obtained by neutralizing a carboxyl group in the α,β-monoethylenic unsaturated carboxylic acid with alkali metal, alkali earth metal, ammonia, or amine (an alkali metal salt, an alkali earth metal salt, an ammonium salt, or an amine salt) and α,β-monoethylenic unsaturated carboxylic acid ester. Examples of the polymer having a carboxyl group also include salts obtained by neutralizing a carboxyl group in the copolymer of α,β-monoethylenic unsaturated carboxylic acid and α,β-monoethylenic unsaturated carboxylic acid ester with alkali metal, alkali earth metal, ammonia, or amine (an alkali metal salt, an alkali earth metal salt, an ammonium salt, or an amine salt). One kind of the polymer having a carboxyl group may be used alone, or two or more kinds of the polymer having a carboxyl group may be used in combination.

Representative examples of α,β-monoethylenic unsaturated carboxylic acid include α,β-unsaturated monocarboxylic acid (acrylic acid, methacrylic acid, and crotonic acid), and α,β-unsaturated dicarboxylic acid (maleic acid, fumaric acid, and itaconic acid). In addition, representative examples of α,β-monoethylenic unsaturated carboxylic acid ester include alkyl esters of (meth)acrylic acid, (meth)acrylate having an alkoxy group, (meth)acrylate having a cyclohexyl group, (meth)acrylate having a hydroxyl group, and polyalkylene glycol mono(meth)acrylate.

Examples of the polymer dispersant include a hydrophilic polymer dispersant. Specific examples of the polymer dispersant include a polymer dispersant having a carboxyl group and having no lipophilic group (a hydroxypropoxy group and a methoxy group) (for example, water-soluble cellulose ether such as carboxymethyl cellulose and carboxyethyl cellulose).

Solvent Removing Process

Next, the organic solvent is removed from the obtained suspension, and a toner particle dispersion is obtained (solvent removing process). This solvent removing process is a process of preparing toner particles by removing the organic solvent contained in liquid droplets of the water-phase solution dispersed in the suspension. The removal of the organic solvent from the suspension may be performed immediately after the suspension preparation process, or may be performed after elapse of 1 minute or more from the completion of the suspension preparation process.

In the solvent removing process, the organic solvent is preferably removed from the suspension by cooling or heating the obtained suspension in a range from 0° C. to 100° C., for example.

As a specific method of removing the organic solvent, the following methods are exemplified.

(1) A method of forcibly updating a gas phase above the surface of the suspension by spraying an air flow to the suspension. In this case, the gas may be blown into the suspension.

(2) A method of reducing the pressure. In this case, the gas phase above the surface of the suspension may be forcibly updated by providing gas, or gas may be blown into the suspension.

The toner particles are obtained through the above processes.

Here, after the completion of the solvent removing process, the toner particles formed in the toner particle dispersion are obtained as toner particles in a dried state after a known washing process, a solid-liquid separation process, and a drying process.

In the washing process, sufficient displacement washing is preferably performed with ion-exchanged water in terms of a charging property.

Suction filtration, pressurizing filtration, or the like is preferably performed as the solid-liquid separation process in terms of productivity though not particularly limited. Also, freeze drying, flash drying, fluidized drying, vibration-type fluidized drying or the like is preferably performed as the drying process in terms of productivity though not particularly limited.

The toner according to the exemplary embodiment is prepared by adding an external additive to the obtained toner particles in the dried state and mixing the external additive and the toner particles, for example.

The mixing is preferably performed with a V blender, a HENSCHEL MIXER, or a LÖDIGE MIXER, for example.

Furthermore, coarse particles of the toner may be removed by using a vibration screening machine, a wind classifier, or the like, if necessary.

The kneading and pulverizing method is a method of obtaining the toner particles having a target particle diameter by mixing the respective materials such as the white colored particles or the colored particles, then melting and kneading the materials by using a kneader, an extruder, or the like, coarsely pulverizing the obtained melted and kneaded material, then pulverizing the material with a jet mill or the like, and subjecting the material to a wind classifier.

More specifically, the kneading and pulverizing method may be divided into a kneading process of kneading toner forming materials including the white colored particles or the colored particles and the binder resin and a pulverizing process of pulverizing the kneaded material. Other processes such as a cooling process of cooling the kneaded material formed by the kneading process may be included, if necessary.

The respective processes related to the kneading and pulverizing method will be described in detail.

Kneading Process

In the kneading process, the toner forming materials including the white colored particles or the colored particles and the binder resin are kneaded.

In the kneading process, 0.5 parts by weight to 5 parts by weight of aqueous medium (water such as distilled water or ion-exchanged water, or alcohols, for example) is preferably added to 100 parts by weight of the toner forming material.

Examples of a kneader used in the kneading process include a single-screw extruder and twin-screw extruder. Although a kneader that has a feeding screw portion and two kneading portions will be described below as an example of the kneader with reference to a drawing, the kneader is not limited thereto.

FIG. 1 is a diagram illustrating a screw state in one example of a screw extruder that is used in the kneading process in the preparing method of the toner according to the exemplary embodiment.

A screw extruder 11 includes a barrel 12 provided with a screw (not illustrated), an inlet port 14 from which the toner forming materials as raw materials of the toner are put into the barrel 12, a liquid addition port 16 for adding the aqueous medium to the toner forming materials in the barrel 12, and a discharge port 18 from which the kneaded material formed by kneading the toner forming materials in the barrel 12 is discharged.

The barrel 12 is divided into a feeding screw portion SA for transporting the toner forming materials, which have been charged from the inlet port 14, to a kneading portion NA, the kneading portion NA for melting and kneading the toner forming materials in a first kneading process, a feeding screw portion SB for transporting the toner forming materials, which have been melted and kneaded in the kneading portion NA, to a kneading portion NB, the kneading portion MB for melting and kneading the toner forming materials in a second kneading process to form a kneaded material, and a feeding screw portion SC for transporting the formed kneaded material to the discharge port 18 in an order from the closest side to the inlet port 14.

Also, temperature control units (not illustrated) that are different for the respective blocks are provided inside the barrel 12. That is, a configuration in which the block 12A to the block 12J may be controlled to mutually different temperatures is employed. FIG. 1 illustrates a state in which the temperature in the block 12A and the block 12B is controlled to t0° C., the temperature in the block 12C to the block 12E is controlled to t1° C., and the temperature in the block 12F to the block 12J is controlled to t2° C., respectively. Therefore, the toner forming materials in the kneading portion NA are heated at t1° C., and the toner forming material in the kneading portion NB are heated at t2° C.

If the toner forming materials including the binder resin, the white colored particles or the colored particles, and if necessary, the release agent are supplied from the inlet port 14 to the barrel 12, the toner forming materials are put into the kneading portion NA by the feeding screw portion SA. Since the temperature in the block 12C is set to t1° C. at this time, the toner forming materials are heated, changed into a melted state, and then put into the kneading portion NA. Since the temperature in the block 12D and the block 12E is also set to t1° C., the toner forming materials are melted and kneaded at the temperature t1° C. in the kneading portion NA. The binder resin and the release agent are brought into the melted state in the kneading portion NA and are sheared by the screw.

Next, the toner forming materials after the kneading at the kneading portion NA are put into the kneading portion NIB by the feeding screw portion SB.

Then, the aqueous medium is added to the toner forming material at the feeding screw portion SB by pouring the aqueous medium from the liquid addition port 16 to the barrel 12. Although FIG. 1 illustrates the state in which the aqueous medium is poured at the feeding screw portion SB, the state is not limited thereto, and the aqueous medium is poured at the kneading portion NB or may be poured at both the feeding screw portion SB and the kneading portion NB. That is, the positions from and to which the aqueous medium is poured are selected as needed.

By pouring the aqueous medium from the liquid addition port 16 to the barrel 12 as described above, the toner forming materials in the barrel 12 and the aqueous medium are mixed, the toner forming materials are cooled by latent heat of vaporization of the aqueous medium, and the temperature of the toner forming materials is maintained.

Finally, the kneaded material formed by being melted and kneaded by the kneading portion NB is transported to the discharge port 18 by the feeding screw portion SC and is then discharged from the discharge port 18.

The kneading process using the screw extruder 11 illustrated in FIG. 1 is performed as described above.

Cooling Process

The cooling process is a process of cooling the kneaded material formed in the above kneading process, and in the cooling process, the cooling is preferably performed from the temperature of the kneaded material at the time of the completion of the kneading process to a temperature of equal to or less than 40° C. at an average temperature lowering rate of equal to or greater than 4° C./sec. There is a case where the mixture (the mixture of the white colored particles or the colored particles and the internal additive such as the release agent internally added to the toner particles as needed) finely dispersed in the binder resin in the kneading process is recrystallized and the dispersion diameter becomes larger at a low cooling rate of the kneaded material. In contrast, it is preferable that the kneaded material be quickly cooled at the average temperature lowering rate since the dispersed state immediately after the completion of the kneading process is maintained with no change. The average temperature lowering rate means an average value of rates at which the temperature of the kneaded material at the time of completion of the kneading process (t2° C. when the screw extruder 11 in FIG. 1 is used, for example) is lowered to 40° C.

Specific examples of a cooling method in the cooling process include a method of using a rolling roll, a pinch-type cooling belt, and the like through which cooling water or brine is circulated. In the case of performing the cooling by the method, the cooling rate is determined by a rate of the rolling roll, the flow rate of the brine, the amount of the kneaded material supplied, the slab thickness at the time of rolling the kneaded material, and the like. The slab thickness is preferably as thin as 1 mm to 3 mm.

Pulverizing Process

The kneaded material cooled in the cooling process is pulverized in the pulverizing process, and the particles are formed. In the pulverizing process, a mechanical grinder, a jet-type grinder, or the like is used. In addition, the particles may be subjected to heating processing with hot wind or the like and may be formed into a spherical shape, if necessary.

Classification Process

The particles obtained by the pulverizing process may be classified in a classification process, if necessary, in order to obtain toner particles having volume average particle diameters within a target range. In the classification process, a centrifugal classifier, an inertial classifier, or the like that has been used in the related art is used to remove minute particles (particles having smaller particle diameters than the target range) and coarse particles (particles having larger particle diameters than the target range).

External Addition Process

For the purpose of charging adjustment, application of fluidity, application of a charge exchanging property, or the like, inorganic particles, representative examples of which include silica, titania, and aluminum oxide, may be added and attached to the obtained toner particles. This is performed by a V blender, a HENSCHEL MIXER, or a LODIGE MIXER, for example, and the inorganic particles may be attached in separate stages. The amount of addition of the external additive is preferably within a range from 0.1 parts by weight to 5 parts by weight, and more preferably within a range from 0.3 parts by weight to 2 parts by weight with respect to 100 parts by weight of the toner particles.

Screening Process

A screening process may be provided, if necessary, after the external addition process. Specific examples of a screening method include a gyroshifter, a vibration screening machine, and a wind classifier. By the screening, coarse particles of the external additive are removed, occurrence of streak on the photoreceptor, contamination in the apparatus, and the like are prevented.

In the exemplary embodiment, an aggregation coalescence method that may easily control the shape and particle diameters of the toner particles and may widely control toner particle structures such as a core-shell structure may be used. Among the methods, the toner particles may be obtained by the aggregation coalescence method.

Hereinafter, a preparing method of the toner particles based on the aggregation coalescence method will be described in detail.

Specifically, the toner particles are prepared by a process of preparing a resin particle dispersion in which resin particles as binder resin are dispersed (resin particle dispersion preparation process), a process of forming aggregate particles by aggregating the resin particles (and other particles, if necessary) in the resin particle dispersion (in a dispersion after mixing other particle dispersions, if necessary) (aggregate particle forming process), and a process of forming the toner particles by heating the aggregate particle dispersion in which the aggregate particles are dispersed, and coalescing the aggregate particles (coalescence process) in the case of preparing the toner particles by the aggregation coalescence method, for example.

Hereinafter, details of the respective process will be described.

Although a method of obtaining toner particles that include the white colored particles or the colored particles and the release agent will be described below, the release agent is used, if necessary. It is a matter of course that additives other than the release agent may be used.

Resin Particle Dispersion Preparation Process

First, a white colored particle dispersion or a colored particle dispersion in which the white colored particles or the colored particles are dispersed and a release agent particle dispersion in which the release agent particles are dispersed are prepared along with a resin particle dispersion in which the resin particles as the binder resin are dispersed.

Here, the resin particle dispersion is prepared by dispersing the resin particles in a dispersion medium by a surfactant.

Examples of the dispersion medium used in the resin particle dispersion include an aqueous medium.

Examples of the aqueous medium include water such as distilled water or ion-exchanged water, and alcohols. One kind or two or more kinds of these water media may be used alone or in combination.

Examples of the surfactant include: an anionic surfactant such as sulfuric acid ester salt surfactant, a sulfonic acid salt surfactant, a phosphoric acid ester surfactant, or a soap surfactant; a cationic surfactant such as an amine salt-type surfactant or a quaternary ammonium salt-type surfactant; and a nonionic surfactant such as a polyethylene glycolsurfactant, an alkylphenole thylene oxide adduct surfactant, or a polyvalent alcohol surfactant. Among these examples, the anionic surfactant and the cationic surfactant are particularly used. The nonionic surfactant may be used with the anionic surfactant or the cationic surfactant.

One kind or two or more kinds of the surfactants may be used alone or in combination.

Examples of a method of dispersing the resin particles in the dispersion medium in the resin particle dispersion include typical dispersion methods using a rotation shear-type homogenizer, a ball mill provided with media, a sand mill, or a dyno mill, for example. The resin particles may be dispersed in the resin particle dispersion according to a phase transition emulsification method, for example, depending on the type of the resin particles.

The phase transition emulsification method is a method of dispersing the resin in a particle state in a water medium by dissolving the resin to be dispersed in a hydrophobic organic solvent in which the resin is soluble, adding a base to an organic continuous phase (O phase), neutralizing the mixture, and pouring the water medium (W phase) to cause transition of the resin (so-called phase transition) from W/O to O/W and obtain non-continuous phase.

The volume average particle diameter of the resin particles dispersed in the resin particle dispersion is preferably from 0.01 μm to 1 μm, more preferably from 0.08 μm to 0.8 μm, and further preferably from 0.1 μm to 0.6 μm, for example.

The volume average particle diameter of the resin particles is measured by using particle diameter distribution obtained by measurement using a laser diffraction-type particle diameter distribution measurement apparatus (LA-700 manufactured by Horiba, Ltd., for example), subtracting cumulative distribution of volumes from the small particle diameter side in divided particle diameter ranges (channels), and regarding a particle diameter corresponding to accumulation of 50% with respect to the entire particles as a volume average particle diameter D50v. The volume average particle diameters of particles in the other dispersions are also measured in the same manner.

The content of the resin particles contained in the resin particle dispersion is preferably from 5% by weight to 50% by weight, and more preferably from 10% by weight to 40% by weight, for example.

The white colored particle dispersion or the colored particle dispersion and the release agent particle dispersion are prepared in the same manner as in the preparation of the resin particle dispersion, for example. That is, the volume average particle diameter of the particles, the dispersion medium, the dispersion method, and the content of the particles in the resin particle dispersion are similarly applied to the white colored particles or the colored particles dispersed in the white colored particle dispersion or the colored particle dispersion and the release agent particles dispersed in the release agent particle dispersion.

Aggregate Particle Formation Process

Next, the white colored particle dispersion or the colored particle dispersion and the release agent particle dispersion are mixed with the resin particle dispersion.

Then, the resin particles, the white colored particles or the colored particles, and the release agent particles are hetero-aggregated to form aggregate particles that include the resin particles, the white colored particles or the colored particles, and the release agent particles with diameters that are close to the targeted toner particle diameter, in the mixed dispersion.

Specifically, for example, an agglomerating agent is added to the mixed dispersion, the pH of the mixed dispersion is adjusted to acidity (pH from 2 to 5, for example), a dispersion stabilizer is added as needed, the resultant is heated to a glass transition temperature of the resin particles, for example, from (the glass transition temperature of the resin particle−30° C.) to (the glass transition temperature−10° C.), the particles dispersed in the mixed dispersion, are aggregated to form aggregate particles.

In the aggregate particle formation process, the heating may be performed after the agglomerating agent is added with the mixed dispersion is stirred with, a rotation-shear-type homogenizer at the room temperature (25° C., for example), the pH of the mixed dispersion is adjusted to acidity (pH from 2 to 5, for example), and a dispersion stabilizer is added as needed, for example.

Examples of the agglomerating agent include a surfactant with polarity opposite to that of the surfactant used as a dispersant to be added to the mixed dispersion, inorganic metal salts, and divalent, or higher metal complexes. In the case where a metal complex is used as the agglomerating agent, in particular, the amount of the surfactant used is reduced, and a charging property is improved.

An additive that forms a complex or similar bond with the metal ions in the agglomerating agent may be used as needed. As the additive, a chelating agent is preferably used.

Examples of the inorganic metal salts include metal salts such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

As the chelating agent, a water-soluble chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The amount of the chelating agent added is preferably from 0.01 parts by weight to 5.0 parts by weight, and more preferably equal to or greater than 0.1 parts by weight and less than 3.0 parts by weight with respect to 100 parts by weight of the resin particles, for example.

Coalescence Process

Next, the aggregate particle dispersion in which the aggregate particles are dispersed is heated at a temperature that is equal to or greater than the glass transition temperature of the resin particles (for example, at a temperature that is higher than the glass transition temperature of the resin particles by 10° C. to 30° C.), for example, the aggregate particles are coalesced, and toner particles are thus formed.

The toner particles are obtained through the processes described hitherto.

The toner particles may be prepared through a process of forming second aggregate particles by obtaining the aggregate particle dispersion in which the aggregate particles are dispersed, then further mixing the aggregate particle dispersion and the resin particle dispersion in which the resin particles are dispersed, and aggregating the resultant such that resin particles are further attached to the surfaces of the aggregate particles, and a process of forming toner particles with a core/shell structure by heating the second aggregate particle dispersion in which the second aggregate particles are dispersed and coalescing the second aggregate particles.

In the case of preparing the toner particles having the core/shell structure by the aggregation coalescence method, two dispersions in which components forming the core particles are dispersed are prepared, a large amount of the agglomerating agent is added to one of the dispersions to promote the aggregate growth, and a smaller amount of the agglomerating agent is added to the other dispersion to cause aggregate growth. By mixing both the dispersions and then forming shell layers after widening the particle diameter distribution by differentiating the growth rates of the aggregate particles as described above, it is possible to form toner particles having controlled particle diameter distribution and shape distribution by the aggregation coalescence method.

Here, the toner particles in a dried state after performing a known cleaning process, a solid-liquid separation process, and a drying process on the toner particles formed in the solution are obtained after the completion of the coalescence process.

In the cleaning process, it is preferable to sufficiently perform replacement cleaning by ion-exchanged water in terms of chargeability. In the solid-liquid separation process, it is preferable to perform, suction filtration, pressurizing filtration, or the like in terms of productivity though not particularly limited. In the drying process, it is preferable to perform freeze drying, flash drying, fluidized drying, or vibration-type fluidized drying in terms of productivity though the method is not particularly limited.

In the toner preparing method, it is possible to control the particle diameter distribution and the shape distribution of the toner particles by employing different, process conditions or using different preparing methods to prepare plural toner particles having different average particle diameters and average circularity and mixing predetermined amounts of the respective toner particles.

For the purpose of charging adjustment, application of fluidity, application of charge exchanging property, or the like, inorganic oxide, representative examples of which include silica, titania, and aluminum oxide, is added and attached as an external additive to the obtained toner particles. Preferable external addition method and the amount of the addition of the external additive are as described above.

Electrostatic Charge Image Developer

The electrostatic charge image developer according to the exemplary embodiment contains at least the white toner according to the exemplary embodiment.

The electrostatic charge image developer may be a one-component developer that contains only the white toner according to the exemplary embodiment or may be a two-component developer in which the toner is mixed with a carrier.

The carrier is not particularly limited, and known carriers are exemplified. Examples of the carrier include a covered carrier in which the surfaces of cores composed of magnetic particles are covered with a covering resin; a magnetic particles dispersed-type carrier in which magnetic particles is dispersed and blended in matrix resin; and resin impregnation-type carrier in which resin is impregnated in porous magnetic particles.

The magnetic particle dispersed-type carrier and the resin impregnation-type carrier may be carrier in which constituent particles of the carriers form cores and the surfaces thereof are covered with the covering resin.

Examples of the magnetic particles include magnetic metal such as iron, nickel, or cobalt, and magnetic oxide such as ferrite and magnetite.

Examples of the covering resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, or straight silicone resin or modified materials thereof that contain an organosiloxane bond, fluorine resin, polyester, polycarbonate, phenol resin, and epoxy resin.

The covering resin and the matrix resin may contain another additive such as conductive particles.

Examples of the conductive particles include: metal such as gold, silver, or copper; and particles of carbon black, titanium oxide, zinc oxide, tin oxide, barium sulfate, aluminum borate, potassium titanate, or the like.

Here, for covering the surfaces of the cores with the covering resin, a covering method using a solution for forming a covering layer that is obtained by dissolving the covering resin, and if necessary, various additives in an appropriate solvent is exemplified. The solvent is not particularly limited and may be selected in consideration of the covering resin used, application aptitudes, and the like.

Specific examples of the resin covering method include a dipping method of dipping the cores in the solution for forming the covering layer, a spray method of spraying the solution for forming the covering layer to the surfaces of the cores, a fluidized bed method of spraying the solution for forming the covering layer in a state in which the cores are made to float by air flow, and a kneader coater method of mixing the cores of the carrier and the solution for forming the covering layer in a kneader coater and then removing a solvent.

A mixing ratio (weight ratio) between the toner and the carrier in the two-component developer is preferably from toner:carrier=1:100 to 30:100, and more preferably from 3:100 to 20:100.

The configuration of the electrostatic charge image developer that includes the color toner or the transparent toner may be the same as that of the electrostatic charge image developer according to the exemplary embodiment except that the white toner is replaced with the color toner or the transparent toner.

Developer Set

The developer set according to the exemplary embodiment includes a white developer that includes white toner that includes white toner particles containing white colored particles and a carrier and at least one kind selected from a color developer that includes a color toner that includes color toner particles containing colored particles and a carrier and a transparent developer that includes a transparent toner that includes transparent toner particles and a carrier, average circularity of the white toner particles is smaller than average circularity of either the color toner particles or the transparent toner particles, and a small-diameter-side number particle diameter distribution index of the white toner particles is greater than a small-diameter-side number particle diameter distribution index of either the color toner particles or the transparent toner particles.

As the white developer that forms the developer set according to the exemplary embodiment, the electrostatic charge image developer according to the exemplary embodiment that includes at least the white toner according to the exemplary embodiment is used. As the color developer and the transparent developer that form, the developer set according to the exemplary embodiment, the developers that are the same as the electrostatic charge image developer according to the exemplary embodiment other than the white toner is replaced with the color toner or the transparent toner are used.

Image Forming Apparatus/Image Forming Method

Description will be given of an image forming apparatus and an image forming method according to the exemplary embodiment.

A first image forming apparatus according to the exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member as a toner image by the electrostatic charge image developer, a transfer unit that transfers the toner image formed on the surface of the image holding member to a surface of a recording medium, and a fixing unit that fixes the toner image transferred to the surface of the recording medium. The electrostatic charge image developer according to the exemplary embodiment is applied as the electrostatic charge image developer.

The first image forming apparatus according to the exemplary embodiment performs the image forming method (a first image forming method according to the exemplary embodiment) including a charging process of charging the surface of the image holding member, an electrostatic charge image formation process of forming the electrostatic charge image on the charged surface of the image holding member, a developing process of developing the electrostatic charge image formed on the surface of the image holding member as the toner image by the electrostatic charge image developer according to the exemplary embodiment, a transfer process of transferring the toner image formed on the surface of the image holding member to the surface of the recording medium, and a fixing process of fixing the toner image transferred to the surface of the recording medium.

As the first image forming apparatus according to the exemplary embodiment, a known image forming apparatus such as: a direct transfer-type apparatus that directly transfers the toner image formed on the surface of the image holding member to the recording medium; an intermediate transfer-type apparatus that primarily transfers the toner image formed on the surface of the image holding member to a surface of an intermediate transfer member and secondarily transfers the toner image transferred to the surface of the intermediate transfer member to the surface of the recording medium; an apparatus provided with a cleaning unit that cleans the surface of the image holding member before the charging and after the transferring of the toner image; or an apparatus provided with a charge eliminating unit that eliminates the charge by irradiating the surface of the image holding member with charge eliminating light before the charging and after the transferring of the toner image is applied.

In a case of the intermediate transfer-type apparatus, a structure including an intermediate transfer member with a surface to which the toner image is transferred, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium, for example, is applied.

A second image forming apparatus according to the exemplary embodiment includes plural toner image forming units that include at least a toner image forming unit that forms a white toner image by using a white toner that includes white toner particles containing white colored particles and a toner image forming unit that forms at least one kind selected from a color toner image and a transparent toner image by using at least one kind selected from a color toner that includes color toner particles containing colored particles and a transparent toner that includes transparent toner particles, a transfer unit that transfers the white toner image and the at least one kind selected from the color toner image and the transparent toner image such that at least one kind selected from the color toner image and the transparent toner image is overlaid on the white toner image on the surface of the recording medium, and a fixing unit that fixes the white toner image and the at least one kind selected from the color toner image and the transparent toner image transferred to the surface of the recording medium, average circularity of the white toner particles is smaller than average circularity of either the color toner particles or the transparent toner particles, and lower GSDp of the white toner particles is greater than, lower GSDp of either the color toner particles or the transparent toner particles. The toner image forming unit may be formed of the image holding member, the charging unit, the electrostatic charge image forming unit, and the developing unit.

The second image forming apparatus according to the embodiment performs a second image forming method according to the exemplary embodiment that includes plural toner image forming processes that include at least a toner image forming process of forming a white toner image by using a white toner that includes white toner particles containing white colored particles and a toner image forming process of forming at least one kind selected from a color toner image or a transparent toner image by using at least one kind selected from a color toner that includes color toner particles containing colored particles and a transparent toner that includes transparent toner particles, a transfer process of transferring the white toner image and the at least one kind selected, from the color toner image or the transparent toner image such that the at least one kind selected from the color toner image and the transparent toner image is overlaid on the white toner image on the surface of the recording medium, and a fixing process of fixing the white toner image and the at least one kind selected from the color toner image and the transparent toner image that are transferred to the surface of the recording medium, average circularity of the white toner particles is smaller than average circularity of either the color toner particles or the transparent toner particles, and lower GSDp of the white toner particles is greater than lower GSDp of either the color toner particles or the transparent toner particles. The toner image forming process includes the charging process, the electrostatic charge image forming process, and the developing process, for example.

In the following description, the first image forming apparatus and the second image forming apparatus according to the exemplary embodiment will be collectively referred to as the image forming apparatus according to the exemplary embodiment. Also, the first image forming method and the second image forming method according to the exemplary embodiment will be collectively referred to as the image forming method according to the exemplary embodiment.

In the image forming apparatus according to the exemplary embodiment, a portion including the developing unit, for example, may have a cartridge structure (process cartridge) that is detachable from the image forming apparatus. As the process cartridge, a process cartridge that accommodates the electrostatic charge image developer according to the exemplary embodiment and is provided with the developing unit is preferably used.

Hereinafter, description will be given of an example of the image forming apparatus according to the exemplary embodiment. However, the image forming apparatus is not limited thereto. Main components illustrated in the drawings will be described, and descriptions of the other components will be omitted.

Figure 2:
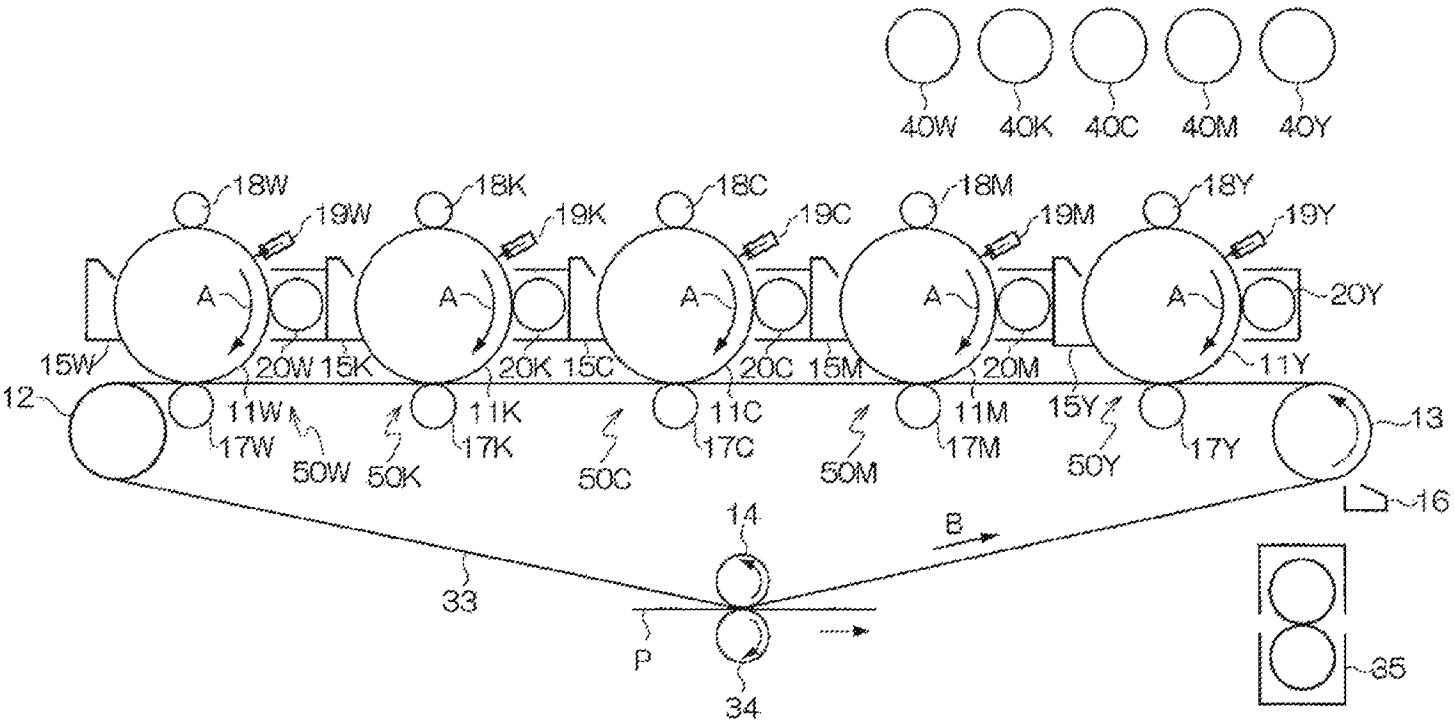
FIG. 2 is a configuration diagram schematically illustrating an example of an image forming apparatus according to the exemplary embodiment.

FIG. 2 is an outline configuration diagram illustrating an example of an image forming apparatus according to the exemplary embodiment. The image forming apparatus according to the exemplary embodiment has a tandem configuration in which plural photoreceptors as image holding members, that is, plural image forming units (image forming units) are provided.

In the following description, a white toner will be used as the toner according to the exemplary embodiment.

In the image forming apparatus according to the exemplary embodiment, four image forming units 50Y, 50M, 50C, and 50K for forming toner images of the respective colors, namely yellow, magenta, cyan, and black and an image forming unit 50W for forming a white toner image are arranged at an interval in parallel (in a tandem manner) as illustrated in FIG. 2. The respective image forming units are aligned in an order of the image forming units 50Y, 50M, 50C, 50K, and 50W from the upstream, side in a rotation direction of an intermediate transfer belt 33.

Here, since the respective image forming units 50Y, 50M, 50C, 50K, and 50W have the same configuration except for the colors of the toners in accommodated developers, the image forming unit 50Y for forming a yellow image will be described as a representative. Descriptions of the respective image forming units 50M, 50C, 50K, and 50W will be omitted by applying reference numerals with magenta (M), cyan (C), black (K), and white (W) instead of yellow (Y) for the same parts as those in the image forming unit 50Y. In the exemplary embodiment, the toner according to the exemplary embodiment is used as a toner (white toner) in a developer accommodated in the image forming unit 50W.

The image forming unit 50Y for the yellow color includes a photoreceptor 11Y as an image holding member, and the photoreceptor 11Y is designed to be rotationally driven at a predetermined process speed by a drive unit, which is not illustrated in the drawing, in the direction of an arrow A in the drawing. An organic photoreceptor is used, for example, as the photoreceptor 11Y.

A charging roll (charging unit) 18Y is provided above the photoreceptor 11Y, a predetermined voltage is applied from a power source, which is not illustrated in the drawing, to the charging roll 18Y, and the surface of the photoreceptor 11Y is charged at a predetermined potential.

An exposure device (electrostatic charge image forming unit) 19Y that forms an electrostatic charge image by exposing the surface of the photoreceptor 11Y is arranged around the photoreceptor 11Y on the downstream side of the rotation direction of the photoreceptor 11Y beyond the charging roll 18Y. Although an LED array that may be realized in a small size is used as the exposure device 19Y for saving a space, the exposure device 19Y is not limited thereto, and it is a matter of course that an electrostatic charge image forming unit using another laser beam may be used.

A developing device (developing unit) 20Y provided with a developer holding member for holding a yellow color developer is arranged around the photoreceptor 11Y on the downstream side of the rotation direction of the photoreceptor 11Y beyond the exposure device 19Y, and a configuration in which an electrostatic charge image formed on the surface of the photoreceptor 11Y is visualized with the yellow color toner and a toner image is formed on the surface of the photoreceptor 11Y is employed.

The intermediate transfer belt (primary transfer unit) 33 for primarily transferring the toner image formed on the surface of the photoreceptor 11Y is arranged below the photoreceptor 11Y so as to stretch over the five photoreceptors 11Y, 11M, 11C, 11K, and 11W on the lower side thereof. The intermediate transfer belt 33 is pressed against the surface of the photoreceptor 11Y by a primary transfer roll 17Y. The intermediate transfer belt 33 is stretched over three rolls, namely a drive roll 12, a support roll 13, and a bias roll 14 and is made to revolve in the direction of an arrow B at the same moving speed as the process speed of the photoreceptor 11Y. The yellow toner image is primarily transferred to the surface of the intermediate transfer belt 33, and toner images of the respective colors, namely magenta, cyan, black, and white are sequentially primarily transferred and layered thereon.

A cleaning device 15Y for cleaning the toner remaining on or retransferred to the surface of the photoreceptor 11Y is arranged around the photoreceptor 11Y on the downstream side of the rotation direction (the direction of the arrow A) of the photoreceptor 11Y beyond the primary transfer roll 17Y. A cleaning blade in the cleaning device 15Y is attached so as to be brought into a pressure contact with the surface of the photoreceptor 11Y in the counter direction.

A secondary transfer roll (secondary transfer unit) 34 is in pressure contact with the bias roll 14, over which the intermediate transfer belt 33 is stretched, via the intermediate transfer belt 33. The toner images primarily transferred and layered on the surface of the intermediate transfer belt 33 are electrostatically transferred to the surface of a recording sheet (recording medium) P supplied from a sheet cassette, which is not illustrated in the drawing, at a nip portion between the bias roll 14 and the secondary transfer roll 34. Since the white toner image is located at the uppermost position (top layer) in the toner images transferred and layered on the intermediate transfer belt 33 at this time, the white toner image is located at the lowermost position (bottom layer) in the toner image transferred to the surface of the recording sheet P.

In addition, a fixing machine (fixing unit) 35 that fixes the multiple toner images transferred on the recording sheet P to the surface of the recording sheet P with heat and a pressure to obtain a permanent image is arranged on the downstream side of the secondary transfer roll 34.

Examples of fixing members included in the fixing machine 35 include a fixing belt that uses a low-surface-energy material, representative examples of which include fluorine resin components and silicone resin, for the surface thereof and has a belt shape and a cylindrical fixing roll that uses a low-surface-energy material, representative examples of which include fluorine resin components and silicone resin, for the surface thereof.

If the surfaces of the fixing members that are brought into contact with the toner images are formed of an elastic material such as a fluorine resin component or silicone resin, it is possible to elastically deform the surfaces of the fixing members at ends of the toner images and to heat the toner images so as to wrap the toner image portions, mixing of the white toner and the color toner and scattering of the white toner tend to be prevented.

Next, operations of the respective image forming units 50Y, 50M, 50C, 50K, and 50W that form images of the respective colors, namely yellow, magenta, cyan, black, and white will be described. Since the operations of the respective image forming units 50Y, 50M, 50C, 50K, and 50W are the same, operations of the image forming unit 50Y for the yellow color will be described as a representative thereof.

In the developing unit 50Y for the yellow color, the photoreceptor 11Y rotates at a predetermined process speed in the direction of the arrow A. The surface of the photoreceptor 11Y is negatively charged at a predetermined potential by the charging roll 18Y. Thereafter, the surface of the photoreceptor 11Y is exposed by the exposure device 19Y, and an electrostatic charge image in accordance with image information is formed thereon. Then, the negatively charged toner is inversely developed by the developing device 20Y, the electrostatic charge image formed on the surface of the photoreceptor 11Y is visualized as an image on the surface of the photoreceptor 11Y, and a toner image is formed. Thereafter, the toner image on the surface of the photoreceptor 11Y is primarily transferred to the surface of the intermediate transfer belt 33 by the primary transfer roll 17Y. After the primary transfer, transfer remaining components such as the toner remaining on the surface of the photoreceptor 11Y are wiped off and cleaned by the cleaning blade of the cleaning device 15Y for the next image forming process.

The operations are performed by the respective image forming units 50Y, 50M, 50C, 50K, and 50W, and the toner images visualized on the surfaces of the respective photoreceptors 11Y, 11M, 11C, 11K, and 11W are successively transferred to the surface of the intermediate transfer belt 33. The toner images of the respective colors are transferred in an order of yellow, magenta, cyan, black, and white in a color mode, and only a single toner image or multiple toner images of necessary colors are also transferred alone or in combination in the same order even when a two-color mode or a three-color mode is set. Thereafter, the single toner image or the multiple toner images transferred to the surface of the intermediate transfer belt 33 are secondarily transferred to the surface of the recording sheet P supplied from the sheet cassette, which is not illustrated in the drawing, by the secondary transfer roll 34, and are then fixed by being heated and pressurized by the fixing machine 35. The toner remaining on the surface of the intermediate transfer belt 33 after the secondary transfer is cleaned by a belt cleaner 16 formed of a cleaning blade for the intermediate transfer belt 33.

In a case where an image forming unit for forming a transparent toner image is arranged in the image forming apparatus according to the exemplary embodiment, the image forming unit is preferably arranged on the upstream side of the rotation direction of the intermediate transfer belt 33 beyond the image forming unit 50Y.

Toner Cartridge and Toner Cartridge Set

Next, a toner cartridge and a toner cartridge set according to the exemplary embodiment will be described.

The toner cartridge according to the exemplary embodiment is a toner cartridge that accommodates the toner according to the exemplary embodiment and is detachable from the image forming apparatus. The toner cartridge accommodates the toner for replenishment to be supplied to the developing unit provided in the image forming apparatus.

The toner cartridge set according to the exemplary embodiment includes a toner cartridge that accommodates a white toner that includes white toner particles containing white colored particles, and at least one kind selected from a toner cartridge that accommodates a color toner that includes color toner particles containing colored particles and a toner cartridge that accommodates a transparent toner containing transparent toner particles, average circularity of the white toner particles is smaller than average circularity of either the color toner particles or the transparent toner particles, and a small-diameter-side number particle diameter distribution index of the white toner particles is greater than a small-diameter-side number particle diameter distribution index of either the color toner particles or the transparent toner particles.

The toner cartridge according to the exemplary embodiment is used as the toner cartridge that accommodates the white toner, which form the toner cartridge set according to the exemplary embodiment. Also, the same toner cartridge as that of the exemplary embodiment except that the white toner is replaced with the color toner or the transparent toner is used as the toner cartridge that accommodates the color toner or the transparent toner, which forms the toner cartridge set according to the exemplary embodiment.

In FIG. 2, the toner cartridges 40Y, 40M, 40C, 40K, and 40W accommodates the toners of the respective colors and are connected to the developing devices corresponding to the respective colors with toner supply tubes which are not illustrated in the drawing. The toner cartridges 40Y, 40M, 40C, 40K, and 40W are toner cartridges that are detachable from the image forming apparatus, and in a case where the toners accommodated in the respective toner cartridge decrease, the toner cartridges are replaced.

Process Cartridge

Description will be given of the process cartridge according to the exemplary embodiment.

The process cartridge according to the exemplary embodiment is a process cartridge that includes a developing unit accommodating the electrostatic charge image developer according to the exemplary embodiment and develops the electrostatic charge image formed on the surface of the image holding member as a toner image by the electrostatic charge image developer and that is detachable from the image forming apparatus.

The process cartridge according to the exemplary embodiment is not limited to the configuration and may have a configuration that includes a developing device, and if necessary, at least one selected from, other units such as an image holding member, a charging unit, an electrostatic charge image forming unit, and a transfer unit.

Although an example of the process cartridge according to the exemplary embodiment will be described below, the process cartridge is not limited thereto. In addition, main components illustrated in the drawings will be described, and descriptions of the other components will be omitted.

Figure 3:
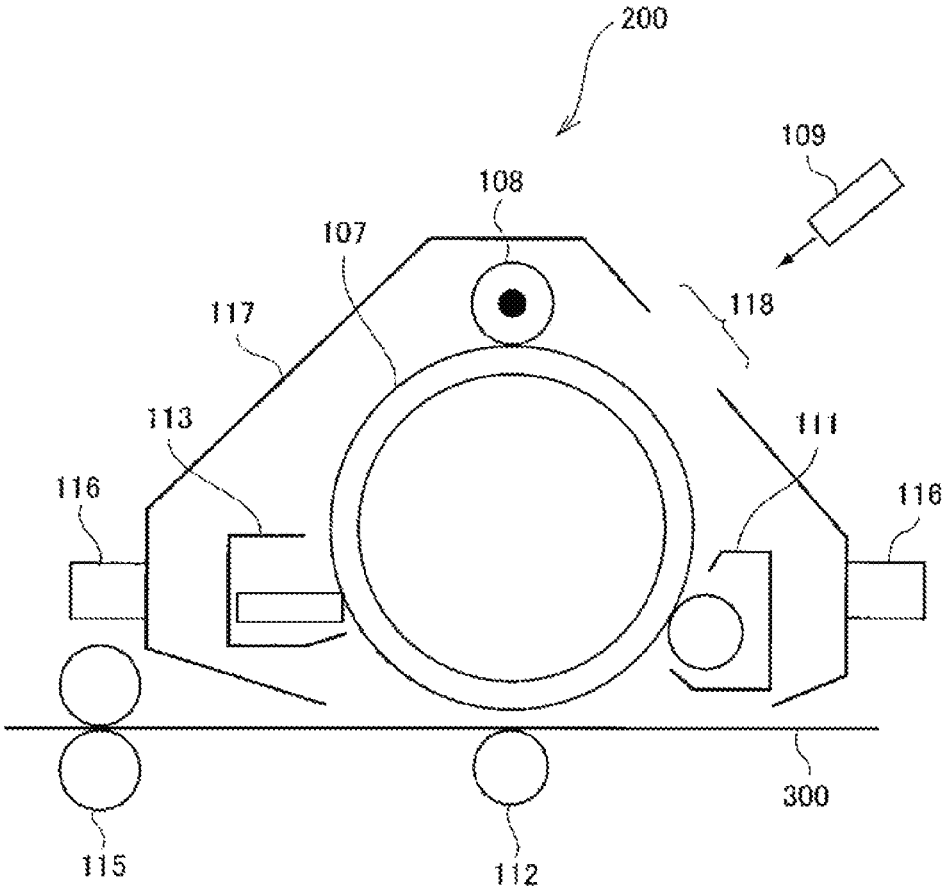
FIG. 3 is a configuration diagram schematically illustrating an example of a process cartridge according to the exemplary embodiment.

FIG. 3 is a configuration diagram, schematically illustrating the process cartridge according to the exemplary embodiment.

The process cartridge 200 illustrated in FIG. 3 integrally combines and holds a photoreceptor 107 (an example of the image holding member), a charging roller 108 (an example of the charging unit) provided in the periphery of the photoreceptor 107, a developing device 111 (an example of the developing unit), and a photoreceptor cleaning device 113 (an example of the cleaning unit) in a housing 117 provided with an attachment rail 116 and an opening 118 for exposure, for example, and is provide as a cartridge.

In FIG. 3, 109 represents an exposure device (an example of the electrostatic charge image forming unit), 112 represents a transfer device (an example of the transfer unit), 115 represents a fixing device (an example of the fixing unit), and 300 represents a recording sheet (an example of the recording medium).

EXAMPLES

Although more specific description will be given below of the exemplary embodiment with reference to examples and comparative examples, the exemplary embodiment is not limited to the following examples. In addition, all the descriptions of "parts" and "%" are on the basis of weight unless otherwise particularly stated.

Preparation of Titanium Oxide Particles (1)

0.15 mol of glycerin is added to 100 mL of 1 mol/L aqueous titanium tetrachloride solution, and the resultant is heated at 90° C. for 4 hours and is then filtered. Obtained white powder is dispersed in 100 mL of ion-exchanged water, 0.4 mol of hydrochloric acid is added thereto, and the resultant is heated again at 90° C. for 3 hours. After pH thereof is adjusted to 7 with sodium hydroxide, the resultant is filtered, washed with water, and is dried at 105° C. for 12 hours, thereby obtaining hydrous titanium dioxide particles (1). 0.25 parts of $Al_2O_3$, 0.1 parts of aluminum sulfate, 1.2 parts of $K_2O$, and 0.01 parts of $P_2O_5$ are mixed with 100 parts of the hydrous titanium dioxide particles (1), and the resultant is calcined at 950° C. for 2 hours, thereby obtaining titanium oxide particles (1) having a number average particle diameter of 500 nm.

Preparation of Titanium Oxide Particles (2)

Titanium oxide particles (2) having a number average particle diameter of 220 nm are obtained in the same manner as in the preparation of the titanium oxide particles (1) except that the amount of $P_2O_5$ is changed to 0.05 parts and the calcination temperature is changed to 930° C.

Preparation of Titanium Oxide Particles (3)

Titanium oxide particles (3) having a number average particle diameter of 570 nm are obtained in the same manner as in the preparation of the titanium oxide particles (1) except that the amount of $P_2O_5$ is changed to 0.005 parts, the amount of $K_2O$ is changed to 1.2 parts, the calcination temperature is changed to 970° C., and the calcination time is changed to 3 hours.

Preparation of Titanium Oxide Particles (4)

Titanium oxide particles (4) having a number average particle diameter of 185 nm are obtained in the same manner as in the preparation of the titanium oxide particles (1) except that the amount of $P_2O_5$ is changed to 0.08 parts, the amount of $K_2O$ is changed to 1.0 part, and the calcination temperature is changed to 930° C.

Preparation of Titanium Oxide Particles (5)

Titanium oxide particles (5) having a number average particle diameter of 305 nm are obtained in the same manner as in the preparation of the titanium oxide particles (1) except that the amount of aluminum sulfate is changed to 0.2 parts, the amount of $K_2O$ is changed to 1.2 parts, and the calcination temperature is changed to 970° C.

Preparation of Titanium Oxide Particles (6)

Titanium oxide particles (6) having a number average particle diameter of 155 nm are obtained in the same manner as in the preparation of the titanium oxide particles (1) except that the amount of $P_2O_5$ is changed to 0.1 parts, the amount of $K_2O$ is changed to 0.5 parts, the calcination temperature is changed to 920° C., and the calculation time is changed to 1.5 hours.

Preparation of White Colored Particles (1)

30 parts of titanium oxide particles (1) and 70 parts of titanium oxide particles (2) are mixed with 200 parts of ion-exchanged water adjusted to the pH to 4 with 0.1 prescribed aqueous hydrogen chloride solution, are dispersed with a ball mill over night, and are kept in a stationary manner, and the supernatant is removed. The resultant is dried for 12 hours by a vacuum freeze drier, is crushed by a jet mill, and is filtered to remove coarse powder, and white colored particles (1), which have a number average particle diameter of 280 nm, in which the proportion of the white colored particles having a particle diameter of 350 nm to 600 nm is 18% by number, are obtained.

Preparation of White Colored Particles (2)

White colored particles (2), which have a number average particle diameter of 215 nm, in which the proportion of the white colored particles having a particle diameter of 350 nm to 600 nm is 20% by number, are obtained in the same manner as in the preparation of the white colored particles (1) except that 30 parts of titanium oxide particles (3) and 70 parts of titanium oxide particles (4) are used.

Preparation of White Colored Particles (3)

White colored particles (3), which have a number average particle diameter of 395 nm, in which the proportion of the white colored particles having a particle diameter of 350 nm to 600 nm is 23% by number, are obtained in the same manner as in the preparation of the white colored particles (1) except that 50 parts of titanium oxide particles (3) and 50 parts of titanium oxide particles (2) are used.

Preparation of White Colored Particles (4)

White colored particles (4), which have a number average particle diameter of 290 nm, in which the proportion of the white colored particles having a particle diameter of 350 nm to 600 nm is 7% by number, are obtained in the same manner as in the preparation of the white colored particles (1) except that 50 parts of titanium oxide particles (1) and 50 parts of titanium oxide particles (2) are used.

Preparation of White Colored Particles (5)

White colored particles (5), which have a number average particle diameter of 305 nm, in which the proportion of the white colored particles having a particle diameter of 350 nm to 600 nm is 47% by number, are obtained in the same manner as in the preparation of the white colored particles (1) except that 70 parts of titanium oxide particles (1) and 30 parts of titanium oxide particles (4) are used.

Preparation of White Colored Particles (6)

White colored particles (6), which have a number average particle diameter of 315 nm, in which the proportion of the white colored particles having particle diameters from 350 nm to 600 nm is 3% by number, are obtained in the same manner as in the preparation of the white colored particles (1) except that 10 parts of titanium oxide particles (1) and 90 parts of titanium oxide particles (5) are used.

Preparation of White Colored Particles (7)

White colored particles (7), which have a number average particle diameter of 295 nm, in which the proportion of the white colored particles having particle diameters from 350 nm to 600 nm is 56% by number, are obtained in the same manner as in the preparation of the white colored particles (1) except that 50 parts of titanium oxide particles (3) and 50 parts of titanium oxide particles (4) are used.

Preparation of White Colored Particles (8)

White colored particles (8), which have a number average particle diameter of 190 nm, in which the proportion of the white colored particles having particle diameters from 350 nm to 600 nm is 20% by number, are obtained in the same manner as in the preparation of the white colored particles (1) except that 30 parts of titanium oxide particles (1) and 70 parts of titanium oxide particles (6) are used.

Preparation of White Colored Particles (9)

White colored particles (9), which have a number average particle diameter of 430 nm, in which the proportion of the white colored particles having particle diameters from 350 nm to 600 nm is 22% by number, are obtained in the same manner as in the preparation of the white colored particles (1) except that 70 parts of titanium oxide particles (1) and 70 parts of titanium oxide particles (5) are used.

Preparation of White Colored Particle Dispersion (1)

White colored particles (1): 30 parts

Anionic surfactant (NEOGEN RK manufactured by DSK Co., Ltd.): 0.3 parts

Ion-exchanged water: 100 parts

After 0.1 mol/L aqueous hydrogen chloride solution is added to ion-exchanged water to adjust the pH to 4.5, the white colored particles (1) and an anionic surfactant are added thereto, and dispersion to the resultant is performed in a round flask made of stainless steel with a homogenizer (ULTRA TURRAX T50 manufactured by IKA) for 5 minutes, thereby obtaining a white colored particle dispersion (1).

Preparation of White Colored Particle Dispersions (2) to (9)

White colored particle dispersions (2) to (9) are obtained in the same manner as in the preparation of the white colored particle dispersion (1) except that the white colored particles (2) to (9) are used instead of the white colored particles (1).

Preparation of White Colored Particle Dispersion (10)

800 parts of zinc sulfate heptahydrate (a zinc grade of 22.3%), 20 parts of aluminum sulfate n-hydrate, and 5 parts of magnesium sulfate heptahydrate are poured into and dissolved in 1,000 parts of ion-exchanged water, thereby obtaining a first aqueous solution. Separately, 500 parts of sodium carbonate is dissolved in 700 parts of pure water, thereby obtaining a second aqueous solution. The second aqueous solution is heated and maintained at 55° C. The first aqueous solution is slowly dropped to the second aqueous solution in a stirred state for 30 minutes. The temperature of the mixed solution is maintained at 55° C. After completion of the dropping, stirring is further performed for 120 minutes to promote the reaction. In this manner, precipitate is formed in the mixed solution. The formed precipitate is washed with ion-exchanged water, and then solid-liquid separation is performed, thereby separating precipitate. The separated precipitate is dried, with a freeze drying machine for 12 hours and is then crushed with a jet mill, thereby obtaining a crushed material. The crushed material is burned at 500° C. for 60 minutes in a nitrogen gas atmosphere containing 3.5% by volume of water vapor and 2.0% by volume of hydrogen gas. The obtained burned material is crushed with a jet mill and is filtered to remove coarse particles, thereby obtaining zinc oxide particles (1) having a number average particle diameter of 250 nm.

White colored particles (10) which have a number average particle diameter of 300 nm in which the proportion of white colored particles having particle diameters from 350 nm to 600 nm is 21% by number are obtained in the same manner except that 70 parts of zinc oxide particles (1) and 30 parts of titanium oxide particles (1) are used in the preparation of the white colored particles (1).

A white colored particle dispersion (10) is obtained in the same manner as in the preparation of the white colored particle dispersion (1) except that the white colored particles (10) are used instead of the white colored particles (1).

Preparation of Cyan Colored Particle Dispersion

C.I. Pigment Blue 15:3 (phthalocyanine pigment manufactured by Dainichiseika Color & Chemicals Mfg. Co., Ltd., cyanine blue 4937): 50 parts Ionic surfactant NEOGEN RK (manufactured by DSK Co., Ltd.): 5 parts Ion-exchanged water: 192.9 parts The above components are mixed and treated by an ultimizer (manufactured by Sugino Machine Limited) at 240 MPa for 10 minutes, thereby preparing a cyan colored particle dispersion (solid content concentration: 20%).

Preparation of Magenta Colored Particle Dispersion

A magenta colored particle dispersion (solid content concentration: 20%) is prepared in the same manner as in the preparation of the cyan colored particle dispersion except that the colorant is changed to C.I. Pigment Red 122 (quinacridone pigment manufactured by Dainichiseika Color & Chemicals Mfg. Co., Ltd., chromofine magenta 6887).

Preparation of Resin Particle Dispersion (1)

An alcohol component including 70 parts by mol of polyoxypropylene (2,2)-2,2-bis(4-hydroxyphenyl)propane, 20 parts by mol of ethylene glycol, and 10 parts by mol of cyclohexanediol and an acid component including 70 parts by mol of terephthalic acid, 15 parts by mol of fumaric acid, and 15 parts by mol of n-dodecenylsuccinic acid are added at a molar ratio of 1:1 in a flask provided with a stirring device, a nitrogen introduction tube, a temperature sensor, and a rectifier, the temperature is raised to 80° C. in a nitrogen atmosphere over 3 hours, and it is confirmed that the materials in the reaction system have been stirred. Thereafter, 1.5 parts of dibutyltin oxide is poured to 100 parts of the mixture, the temperature is further raised to 185° C. from the same temperature over 2 hours while generated water is distilled, and a dehydration condensation reaction is further continued at 185° C. for 6 hours, thereby obtaining resin (A).

100 parts of the resin (A) is heated and the resin (A) being in the melted state is transported to a Cavitron GD1010 (manufactured by Euro Tech) at a rate of 10 parts per minute. Diluted ammonia aqueous solution having a concentration of 0.5% obtained by diluting reagent ammonia aqueous solution with ion-exchanged water is put in a separately prepared aqueous medium tank, the diluted ammonia aqueous solution is transported to the Cavitron CD1010 (manufactured by Euro Tech) at a speed of 10 parts per minute while heating the diluted ammonium aqueous solution at 96° C. with a heat exchanger at the same time with the resin (A) melt. The Cavitron is operated under conditions of a rotator rotation speed of 60 Hz and a pressure of 5 kg/cm$^2$. Thereafter, the pH of the system is adjusted to 8.6 with 0.4 mol/L of aqueous sodium hydroxide solution, treatment is performed at 50° C. for 5 hours, ion-exchanged water is then added thereto to adjust the solid content concentration to 25%, and the pH is adjusted to 7.2 with an aqueous nitric acid solution, thereby obtaining a resin particle dispersion (1).

Preparation of Resin Particle Dispersion (2)

After 50.2 parts by mol of dimethyl sebacate, 49.8 parts by mol of 1,10-decanediol, 20 parts of dimethyl sulfoxide with respect to 100 parts by a monomer component, and 0.05 parts of dibutyltin oxide as a catalyst with respect to 100 parts of the monomer component are added to a heated and dried three-neck flask, the air in the container is set to an inert atmosphere with nitrogen gas under a depressurization operation, and the material is stirred at 175° C. for 6 hours by mechanical stirring. Dimethyl sulfoxide is distilled under a reduced pressure, the temperature is then slowly raised to 210° C. under a reduced pressure, the material is stirred for 2 hours, and when the material becomes a viscous state, the material is cooled with air, and the reaction is stopped, thereby obtaining resin (B).

A resin mixture obtained by heating a mixture of 85 parts of the resin (A) and 15 parts of the resin (B) being in a melted state is transported to a Cavitron CD1010 (manufactured by Euro Tech) at a speed of 10 parts per minute. A diluted ammonia aqueous solution having a concentration of 0.5% obtained by diluting reagent ammonia aqueous solution with ion-exchanged water is poured in a separately prepared aqueous medium tank and, at the same time with a resin mixture melt, is transported to the Cavitron CD1010 (manufactured by Euro Tech) at a speed of 10 parts per minute while the diluted ammonium aqueous solution is heated at 96° C. with a heat exchanger. The Cavitron is operated under conditions of a rotator rotation speed of 60 Hz and a pressure of 5 kg/cm$^2$. Thereafter, the pH of the system is adjusted to 8.6 with 0.4 mol/L of aqueous sodium hydroxide solution, the resultant is treated at 50° C. for 5 hours, ion-exchanged water is added thereto so as to adjust the solid content concentration to 25%, and the pH is then adjusted to 7.2 with an aqueous nitric acid solution, thereby obtaining a resin particle dispersion (2).

Preparation of Release Agent Particle Dispersion (1)

Paraffin wax (HNP-9 manufactured by Nippon Seiro Co., Ltd.): 100 parts

Anionic surfactant (NEOGEN RK manufactured by DSK Co., Ltd.): 1.5 parts

Ion-exchanged water: 400 parts

The above components are dispersed in a round flask made of stainless steel with a homogenizer (ULTRA TURRAX T50 manufactured by IKA) for 20 minutes and are then subjected to dispersion processing using pressure ejection-type homogenizer, thereby preparing a release agent particle dispersion (1) in which the release agent is dispersed.

Preparation of Toner (1)

Resin particle dispersion (2): 200 parts

Release agent particle dispersion (1): 25 parts

White colored particle dispersion (1): 161 parts

Anionic surfactant (TeycaPower): 1.0 part

Ion-exchanged water: 100 parts

The above raw materials are put in a cylindrical stainless steel container and are dispersed and mixed for 5 minutes with a homogenizer (ULTRA TURRAX T50 manufactured by IKA) by setting the rotational frequency of the homogenizer to 4,000 rpm while applying shear force. Then, 1.5 parts of 10% aqueous nitric acid solution of polyaluminum chloride is slowly dropped, and the resultant is dispersed and mixed for 5 minutes with the homogenizer at a rotational frequency of 5,000 rpm, thereby obtaining a raw material dispersion (1). The raw material dispersion (1) is stirred with a stirring blade attached to the cylindrical stainless steel container until experiments to use the same are started.

Resin particle dispersion (2): 20 parts

Release agent particle dispersion (1): 2.5 parts

White colored particle dispersion (1): 16.1 parts

Ion-exchanged water: 10 parts

The above raw materials are put in a cylindrical stainless steel container, the pH is adjusted to 4.0 by adding 0.1 mmol/L of an aqueous hydrogen chloride solution, and the raw materials are dispersed and mixed for 5 minutes with the homogenizer (ULTRA TURRAX T50 manufactured by IKA) at a rotational frequency of 4,000 rpm while applying shear force. Then, 0.5 parts of 10% aqueous solution of aluminum sulfate is slowly dropped, and the materials are dispersed and mixed for 5 minutes by setting the rotational frequency of the homogenizer to 5,000 rpm, thereby obtaining a raw material dispersion (2). The raw material dispersion (2) is stirred with a stirring blade attached to the cylindrical stainless steel container until experiments to use the same are started.

The raw material dispersion (1) is heated to 45° C. while being stirred in a heating oil bath. After the raw material dispersion (1) is kept at 45° C. for 60 minutes, the temperature of the heating oil bath is raised to 50° C. and maintained for 3 hours. Thereafter, 0.005 parts of anionic surfactant (TeycaPower) is added thereto, the temperature is slowly lowered to 35° C. while the stirring is further continued, the raw material dispersion (2) is dropped and mixed while the temperature is maintained at 35° C., after the completion of the dropping, the materials are heated to 52° C. while the stirring is continued, and the temperature is kept at 52° C. for 0.5 hours. Thereafter, 30 parts of resin particle dispersion (1) is added, and the temperature of the heating oil bath is then raised to 55° C. and is kept for 20 minutes. 1N sodium hydroxide is added to the dispersion, the pH of the system is adjusted to 8.0, the flask made of stainless steel is then tightly closed, and the material is heated to 85° C. while stirring is continued with a magnetic seal, and is kept for 150 minutes. After the material is cooled with ice water, the toner particles are filtered off, are washed with ion-exchanged water at 25° C. five times, and are then freeze dried, thereby obtaining toner particles (1).

The lower GSDp of the toner particles (1) is 1.27, the average circularity is 0.962, and the D16p average circularity of the toner particles (1) is 0.966.

100 parts of toner particles (1), 0.3 parts of hydrophobic silica RX50 manufactured by Japan Aerosil as an external additive, and 1.0 part of hydrophobic silica R972 manufactured by Japan Aerosil are blended in a HENSCHEL MIXER at a circumferential rate of 20 m/s for 15 minutes, and coarse particles are removed by using a sieve with a mesh of 45 μm, thereby obtaining a toner (1).

Preparation of Toner (2)

Toner particles (2) and a toner (2) are obtained in the same manner as in the preparation of the toner (1) except that the white colored particle dispersion (1) is replaced with the white colored particle dispersion (2).

The lower GSDp of the toner particles (2) is 1.29, the average circularity is 0.965, and the D16p average circularity of the toner particles (2) is 0.969.

Preparation of Toner (3)

Toner particles (3) and a toner (3) are obtained in the same manner as in the preparation of the toner (1) except that the white colored particle dispersion (1) is replaced with the white colored particle dispersion (3).

The lower GSDp of the toner particles (3) is 1.26, the average circularity is 0.963, and the D16p average circularity of the toner particles (3) is 0.967.

Preparation of Toner (4)

Toner particles (4) and a toner (4) are obtained in the same manner as in the preparation of the toner (1) except that the white colored particle dispersion (1) is replaced with the white colored particle dispersion (4).

The lower GSDp of the toner particles (4) is 1.25, the average circularity is 0.960, and the D16p average circularity of the toner particles (4) is 0.963.

Preparation of Toner (5)

Toner particles (5) and a toner (5) are obtained in the same manner as in the preparation of the toner (1) except that the white colored particle dispersion (1) is replaced with the white colored particle dispersion (5).

The lower GSDp of the toner particles (5) is 1.29, the average circularity is 0.967, and the D16p average circularity of the toner particles (5) is 0.969.

Preparation of Toner (6)

Toner particles (6) and a toner (6) are obtained in the same manner as in the preparation of the toner (1) except that the white colored particle dispersion (1) is replaced with the white colored particle dispersion (6).

The lower GSDp of the toner particles (6) is 1.30, the average circularity is 0.959, and the D16p average circularity of the toner particles (6) is 0.970.

Preparation of Toner (7)

Toner particles (7) and a toner (7) are obtained in the same manner as in the preparation of the toner (1) except that the white colored particle dispersion (1) is replaced with the white colored particle dispersion (7).

The lower GSDp of the toner particles (7) is 1.27, the average circularity is 0.960, and the D16p average circularity of the toner particles (7) is 0.967.

Preparation of Toner (8)

Toner particles (8) and a toner (8) are obtained in the same manner as in the preparation of the toner (1) except that the white colored particle dispersion (1) is replaced with the white colored particle dispersion (8).

The lower GSDp of the toner particles (8) is 1.26, the average circularity is 0.965, and the D16p average circularity of the toner particles (8) is 0.969.

Preparation of Toner (9)

Toner particles (9) and a toner (9) are obtained in the same manner as in the preparation of the toner (1) except that the white colored particle dispersion (1) is replaced with the white colored particle dispersion (9).

The lower GSDp of the toner particles (9) is 1.29, the average circularity is 0.965, and the D16p average circularity of the toner particles (9) is 0.969.

Preparation of Toner (10)

Toner particles (10) and a toner (10) are obtained in the same manner as in the preparation of the toner (1) except that the white colored particle dispersion (1) is replaced with the white colored particle dispersion (10).

The lower GSDp of the toner particles (10) is 1.26, the average circularity is 0.962, and the D16p average circularity of the toner particles (10) is 0.967.

Preparation of toner (11)

Resin particle dispersion (2): 220 parts
Release agent particle dispersion (1): 27.5 parts
White colored particle dispersion (1): 177.1 parts
Anionic surfactant (TeycaPower): 1.005 parts
Ion-exchanged water: 110 parts The above raw materials are put in a cylindrical stainless steel container and are dispersed and mixed for 5 minutes with a homogenizer (ULTRA TURRAX T50 manufactured by IKA) at a rotational frequency of 4,000 rpm while shear force is applied. Then, 1.5 parts of 10% aqueous nitric acid solution of polyaluminum chloride is slowly dropped, and the materials are dispersed and mixed for 5 minutes by setting the rotational frequency of the homogenizer to 5,000 rpm, thereby obtaining a raw material dispersion (11). The raw material dispersion (11) is stirred by a stirring blade attached to the cylindrical stainless steel container until experiments to use the same are started.

The raw material dispersion (11) is heated to 45° C. in a heating oil bath while being stirred. After the raw material dispersion (11) is kept at 45° C. for 60 minutes, the temperature of the heating oil bath is raised to 50° C. and is maintained for 3 hours. Thereafter, 15 parts of the resin particle dispersion (1) is added, the temperature of the heating oil bath is raised to 55° C. and is kept for 20 minutes. Furthermore, 15 parts of the resin particle dispersion (1) is added while it is confirmed that the liquid surface is sufficiently moving by enhancing the stirring, and the temperature of the heating oil bath is raised to 60° C. and kept for 30 minutes. After it is confirmed that the viscosity of the dispersion in the stainless steel container has been sufficiently lowered, 1N sodium hydroxide is added to the dispersion, the pH of the system is adjusted to 8.0, the flask made of stainless steel is tightly closed, and the material is heated to 85° C. while stirring is continued with a magnetic seal, and is then kept for 150 minutes. After the material is cooled with ice water, the toner particles are filtered off, are washed with ion-exchanged water at 25° C. five times, and are then freeze dried, thereby obtaining toner particles (11).

The lower GSDp of the toner particles (11) is 1.26, the average circularity is 0.961, and the D16p average circularity of the toner particles (11) is 0.963.

Preparation of Toner (12)

Toner particles (12) and a toner (12) are obtained in the same manner as in the preparation of the toner (1) except that the amount of the anionic surfactant (TeycaPower) added after heating the material at 50° C. and holding the material for 3 hours is changed to 0.05 parts.

The lower GSDp of the toner particles (12) is 1.35, the average circularity is 0.963, and the D16p average circularity of the toner particles (12) is 0.965.

Preparation of Toner (13)

Toner particles (13) and a toner (13) are obtained in the same manner as in the preparation of the toner (1) except that the heating temperature in the process in which the pH of the system is adjusted to 8.0, the flask made of stainless steel is tightly closed, the material is heated and maintained for 150 minutes while stirring is continued with a magnetic seal is changed to 80° C. and the temperature is then slowly-lowered to 30° C. at a speed of 5° C./minute without cooling with ice water.

The lower GSDp of the toner particles (13) is 1.29, the average circularity is 0.951, and the D16p average circularity of the toner particles (13) is 0.956.

Preparation of Toner (14)

Toner particles (14) and a toner (14) are obtained in the same manner as in the preparation of the toner (1) except that the heating temperature in the process in which the pH of the system is adjusted to 8.0, the flask made of stainless steel is tightly closed, the material is heated and maintained for 150 minutes while stirring is continued with a magnetic seal is changed to 92° C.

The lower GSDp of the toner particles (14) is 1.31, the average circularity is 0.975, and the D16p average circularity of the toner particles (14) is 0.978.

Preparation of Toner (15)

Toner particles (15) and a toner (15) are obtained in the same manner as in the preparation of the toner (1) except that the heating temperature, in the process in which the pH of the system is adjusted to 8.0, the flask made of stainless steel is tightly closed, the material is heated and maintained for a specific period of time while stirring is continued with a magnetic seal, is changed to 92° C., the keeping time is changed to 1 hour, and the temperature is then slowly lowered to 25° C. at a speed of 5° C./minute without cooling with ice water.

The lower GSDp of the toner particles (15) is 1.26, the average circularity is 0.961, and the D16p average circularity of the toner particles (15) is 0.963.

Preparation of Toner (16)

(Preparation of Unmodified Polyester Resin (1)

Terephthalic acid: 1,243 parts
Bisphenol A ethylene oxide adduct: 1,800 parts
Bisphenol A propylene oxide adduct: 800 parts The above components are heated and mixed at 185° C., 2.5 parts of dibutyltin oxide is added, and heating is performed at 225° C. to distill away water, thereby obtaining unmodified polyester resin.

Preparation of polyester prepolymer (1)

Terephthalic acid: 1255 parts
Bisphenol A ethylene oxide adduct: 1,845 parts
Bisphenol A propylene oxide adduct: 850 parts The above components are heated and mixed at 180° C., 2.5 parts of dibutyltin oxide is added, and heating is performed at 225° C. to distill away water, thereby obtaining polyester. 350 parts of obtained polyester, 55 parts of tolylene diisocyanate, and 500 parts of ethyl acetate are put in a container, and the mixture is heated at 120° C. for 5 hours, thereby obtaining polyester prepolymer (1) with isocyanate groups (hereinafter, "isocyanate-modified polyester prepolymer (1)").

Preparation of Ketimine Compound (1)

60 parts of methyl ethyl ketone and 155 parts of hexamethylenediamine are put in a container and are stirred at 65° C., thereby obtaining a ketimine compound (1).

Preparation of White Colored Particle Dispersion (11)

White colored particles (1): 100 parts

Ethyl acetate: 500 parts

The above components are mixed, an operation of filtering the mixture and further mixing with 500 parts of ethyl acetate is repeated five times, and the mixture is then dispersed by using an emulsion disperser Cavitron (CR1010 manufactured by Pacific Machinery & Engineering Co., Ltd.) for 1 hour, thereby obtaining a white colored particle dispersion (11) (solid content concentration: 10%).

Preparation of Release Agent Particle Dispersion (2)

Paraffin wax (melting temperature of 89° C.): 30 parts

Ethyl acetate: 270 parts

The above components being in a state of being cooled at 10° C. are wet-pulverized by a microbead-type dispersing machine (DCP mill), thereby obtaining a release agent particle dispersion (2).

Preparation of Oil-Phase Solution (1)

Unmodified polyester resin (1): 136 parts

White colored particles dispersion (11): 630 parts

Ethyl acetate: 56 parts

The above components are stirred and mixed, 75 parts of the release agent particle dispersion (2) is then added to the obtained mixture, and the mixture is stirred, thereby obtaining an oil-phase solution (1).

Preparation of Styrene Acrylic Resin Particle Dispersion (1)

Styrene: 400 parts n-butyl acrylate: 30 parts

Acrylic acid: 4 parts

Dodecanethiol: 25 parts

Carbon tetrabromide: 5 parts

The above components are mixed, the dissolved mixture is emulsified in an aqueous solution obtained by dissolving 5 parts of nonionic surfactant (NONIPOL 400 manufactured by Sanyo Chemical Industries, Ltd.) and 10 parts of anionic surfactant (NEOGEN SC manufactured by DSK Co., Ltd.) in 560 parts of ion-exchanged water in a flask, an aqueous solution obtained by dissolving 4 parts of ammonium persulfate in 50 parts of ion-exchanged water is poured thereto while being stirred for 10 minutes, substitution with nitrogen is performed, the content in the flask is heated to 70° C. in an oil bath while the content is stirred, and the emulsion polymerization is just continued for 5 hours, thereby obtaining styrene acrylic resin particle dispersion (1) in which the resin particles are dispersed.

Preparation of Water-Phase Solution (1)

Styrene acrylic resin particle dispersion (1): 60 parts

2% aqueous solution of CELOGEN BS-H (DSK Co., Ltd.): 200 parts

Ion-exchanged water: 200 parts

The above components are stirred and mixed, thereby obtaining a water-phase solution (1).

Preparation of Toner Particles (16)

Oil-phase solution (1): 300 parts

Isocyanate-modified polyester prepolymer (1): 25 parts

Ketimine compound (1): 1.5 parts

The above components are put in a container and are stirred for 2 minutes by a homogenizer (ULTRA TURRAX manufactured by IKA), thereby obtaining an oil-phase solution (1P). Thereafter, 1,000 parts of water-phase solution (1) is added to the container, and the materials are stirred with the homogenizer for 20 minutes. Next, the mixed solution is stirred at the room temperature (25° C.) under an ordinary pressure (1 atm) for 48 hours with a propeller-type stirring machine to cause a reaction between the isocyanate-modified polyester prepolymer (1) and the ketimine compound (1) to prepare urea-modified polyester resin, and the organic solvent is removed therefrom, thereby forming particulate materials. Next, the particulate materials are washed with water, and are dried and classified, thereby obtaining toner particles (16).

A toner (16) is obtained in the same manner as in the preparation of the toner (1) except that the toner particles (1) are replaced with the toner particles (16).

The lower GSDp of the toner particles (16) is 1.34, the average circularity is 0.966, and the D16p average circularity of the toner particles (16) is 0.969.

Preparation of Toner (17)

Preparation of Styrene Acrylic Resin Particle Dispersion (1)

Styrene: 190 parts

Acrylic acid: 10 parts

Anionic surfactant (DOWFAX manufactured by Dow Chemical Company): 5 parts

Ion-exchanged water: 735 parts 190 parts of styrene and 10 parts of acrylic acid are mixed, thereby preparing a mixture solution.

Meanwhile, a material obtained by dissolving 5 parts of anionic surfactant in 700 parts of ion-exchanged water is accommodated in a 2 L flask, the mixture solution is added thereto, dispersed and emulsified therein, and an ammonium persulfate solution is poured thereto at a speed of 35 parts/60 minutes while being stirred and mixed at 10 rpm with a semilunar-shaped stirring blade, thereby preparing a styrene acrylic resin particle dispersion (1). Here, the ammonium persulfate solution is prepared by dissolving 5 parts of ammonium persulfate in 35 parts of ion-exchanged water.

Preparation of toner particles

Styrene acrylic resin particle dispersion (1): 238 parts

White colored particle dispersion (1): 161 parts

Release agent particle dispersion (1): 25 parts

The above materials are put in a round flask made of stainless steel, 0.1 N nitric acid is added thereto to adjust the pH to 4.0, and 3 parts of aqueous nitric acid solution with polyaluminum chloride concentration of 10% is then added. Subsequently, the materials are dispersed at 30° C. with a homogenizer (ULTRA TURRAX T50 manufactured by IKA), are then heated to 45° C. in a heating oil bath, and are then kept for 30 minutes, thereby obtaining a raw material dispersion (17-1). The raw material dispersion (17-1) is stirred with a stirring blade attached to a cylindrical stainless steel container until experiments to use the same are started.

Styrene acrylic resin particle dispersion (1): 24 parts

Release agent particle dispersion (1): 2.5 parts

White colored particle dispersion (1): 16.1 parts

Ion-exchanged water: 10 parts

The above raw materials are put in a cylindrical stainless steel container, 0.1 mol/L aqueous hydrogen chloride solution is added thereto to adjust the pH to 4.0, and the materials are dispersed and mixed for 5 minutes with a homogenizer (ULTRA TURRAX T50 manufactured by IKA) at a rotational frequency of 4,000 rpm while shear force is applied thereto. Then, 1 part of 10% aqueous solution of aluminum sulfate is slowly dropped, and the materials are dispersed and mixed for 5 minutes by setting the rotational frequency of the homogenizer to 5,000 rpm, thereby obtaining a raw material dispersion (17-2). The raw material dispersion (17-2) is stirred with a stirring blade attached to a cylindrical stainless steel container until experiments to use the same are started.

The raw material dispersion (17-1) is heated to 45° C. in a heating oil bath while being stirred. After the raw material dispersion (17-1) is kept at 55° C. for 60 minutes, the temperature of the heating oil bath is raised to 55° C. and is kept for 3 hours. Thereafter, 0.01 parts of anionic surfactant (TeycaPower) is added thereto, the temperature is slowly lowered to 40° C. while the stirring is continued, the raw material dispersion (17-2) is dropped and mixed while the temperature is maintained at 40° C., after completion of the dropping, the materials are heated to 60° C. while the stirring is continued, and are maintained at 60° C. for 0.5 hours. Thereafter, 36 parts of styrene acrylic resin particle dispersion (1) is added thereto, and the temperature of the heating oil bath is raised to 65° C. and is kept for 20 minutes. 1N sodium hydroxide is added to the dispersion, the pH of the system is adjusted to 9.0, the flask made of stainless steel is then tightly closed, and the materials are heated to 97° C. while the stirring is continued with a magnetic seal, and are kept for 150 minutes. After cooling with ice water, toner particles are filtered off, washed with ion-exchanged water at 25° C. five times, and are freeze dried, thereby obtaining toner particles (17).

The lower GSDp of the toner particles (17) is 1.28, the average circularity is 0.962, and the D16p average circularity of the toner particles (17) is 0.967.

Preparation of Toner (18)

Toner particles (18) are obtained by performing minute cutting on the toner particles (14) with an elbow jet classifier. A toner (18) is obtained in the same manner as in the preparation of the toner (1) except that the toner particles (1) are replaced with the toner particles (18).

The lower GSDp of the toner particles (18) is 1.16, the average circularity is 0.974, and the D16p average circularity is 0.976.

Preparation of Toner (19)

Toner particles (19) and a toner (19) are obtained in the same manner as in the preparation of the toner (18) except that the toner particles (1) are used instead of the toner particles (14).

The lower bSDp of the toner particles (19) is 1.18, the average circularity is 0.961, and the D16p average circularity is 0.963.

Preparation of Cyan Toner

Resin particle dispersion (2): 220 parts
Release agent particle dispersion (1): 27.5 parts
Cyan colored particle dispersion: 25 parts
Anionic surfactant (TeycaPower): 1.0 part
Ion-exchanged water: 110 parts The above raw materials are put in a cylindrical stainless steel container and are dispersed and mixed for 5 minutes with a homogenizer (ULTRA TURRAX T50 manufactured by IKA) at a rotational frequency of 4,000 rpm while shear force is applied thereto. Then, 1.5 parts of 10% aqueous nitric acid solution of polyaluminum chloride is slowly dropped, and the materials are dispersed and mixed for 5 minutes by setting the rotational frequency of the homogenizer to 5,000 rpm. The raw material dispersion is heated to 45° C. in a heating oil bath while being stirred. After the raw material dispersion is kept at 45° C. for 60 minutes, the temperature of the heating oil bath is raised to 50° C. and is kept for 3 hours. Thereafter, 30 parts of resin particle dispersion (1) is added thereto, and the temperature of the heating oil bath is then raised to 55° C. and is kept for 20 minutes. 1N sodium hydroxide is added to the dispersion, the pH of the system is adjusted to 8.0, the flask made of stainless steel is then tightly closed, and the materials are heated to 85° C. while the stirring is continued with a magnetic seal, and are kept for 18.0 minutes. After cooling with ice water, toner particles are filtered off, washed with ion-exchanged water at 25° C. five times, and are freeze dried, thereby obtaining cyan toner particles. A cyan toner is obtained in the same manner as in the preparation of the toner (1) except that the cyan toner particles are used instead of the toner particles (1).

The lower GSDp of the cyan toner particles is 1.21, the average circularity is 0.971, and the D16p average circularity of the cyan toner particles is 0.972.

Preparation of Magenta Toner

Magenta toner particles and a magenta toner are obtained in the same manner as in the preparation of the cyan toner except that the white colored particle dispersion (1) is replaced with a magenta colorant dispersion.

The lower GSDp of the magenta toner particles is 1.20, the average circularity is 0.970, and the D16p average circularity of the magenta toner particles is 0.970.

Preparation of Transparent Toner

Transparent toner particles and a transparent toner are obtained in the same manner as in the preparation of the cyan toner except that the cyan colored particle dispersion is not used and the amount of the resin particle dispersion (2) is changed to 235 parts.

The lower GSDp of the transparent toner particles is 1.18, the average circularity is 0.972, and the D16p average circularity is 0.972.

Preparation of Developers 36 parts of each toner and 414 parts of a carrier are put in a 2-liter V blender, are stirred for 20 minutes, and are then filtered at 212 μm, thereby preparing developers that include the respective toners. As the carrier, a carrier obtained by the method described below is used.

Preparation of Carrier

Ferrite particles (volume average particle diameter: 35 μm): 100 parts
Toluene: 14 parts
Methyl methacrylate-perfluorooctylethyl acrylate copolymer: 1.6 parts
Carbon black (product name: VXC-72 manufactured by Cabot Corporation, volume resistivity: 100 Ωcm or less): 0.05 parts
Crosslinked melamine resin particles (average particle diameter: 0.3 μm, insoluble in toluene): 0.5 parts First, carbon black diluted in toluene is added to methyl methacrylate-perfluorooctylethyl acrylate copolymer and is dispersed with a sand mill. Then, the above respective components other than the ferrite particles are dispersed therein with a stirrer for 10 minutes, thereby preparing a solution for forming a covering layer. Then, the solution for forming a covering layer and the ferrite particles are put in a vacuum degassing-type kneader, are stirred at a temperature of 60° C. for 30 minutes, the pressure is reduced to distill toluene, and a resin covering layer is formed, thereby obtaining a carrier.

Examples 1A to 13A and Comparative Examples 1A to 4A

The following evaluation is conducted by using developers that include the toner particles shown in Table 1. The following evaluation is conducted under an environment at a temperature of 25° C. and a moisture of 30% RH.

The white developer is put into the fifth engine of a modified machine of Color Press 1000i manufactured by Fuji Xerox Co., Ltd. (a machine modified so as to be able to perform output in a state where a developer is accommodated in at least a single developing machine if no developer is in the other developing machines), and solid images of the white toner are successively formed on 100 FANTAS black papers ((name of product) manufactured by Fujikyowa Seishi; ream weight: 270 kg). Furthermore, grid-shaped line images composed of straight lines of 10 points are formed. The toner applied amount for all the images is set to 11 g/m$^2$.

A white toner scattering level of the grid-shaped line image of the white toner provided on the 101-th paper is observed and evaluated in four stages, namely A, B, C, or D. The evaluation criteria are as follows.

Brightness of the solid image L* on the 100-th paper is measured by using X-Rite 939 (aperture diameter: 4 mm, manufactured by X-Rite Inc.), Lower L* means lower hiding properties and inferior whiteness. L* that is equal to or greater than 70 is sufficient as a white image for practical use, and higher L* means that the image has higher whiteness.

The obtained results will be shown in Table 1.

A: A level in which no scattering of the white toner is seen at the boundary of the image even if the image is observed with a loupe of 50-fold; further, L* is equal to or greater than 75, and the image exhibits high whiteness and is excellent.

B: A level in which slight scattering of the white toner is observed at the boundary of the image if the image is observed with the loupe of 50-fold though the scattering is not able to be visually recognized; alternatively, a level in which L* is equal to or greater than 70 and less than 75, which is not problematic as a white image in practical use.

C: A level in which there is no problem in practical use though slight scattering is observed when carefully viewed; alternatively, a level in which L* is equal to or greater than 60 and less than 70 and whiteness is inferior depending on conditions of use.

D: A level in which scattering is easily visually observed and there is a problem in practical use; alternatively, a level in which L* is less than 60 and a hiding property is in sufficient as a white image.

In Table 1, "Proportion of specific particles" means a proportion of the white colored particles having a particle diameter of 350 nm to 600 nm with respect to the entire white colored particles.

Examples 1B to 3B and Comparative Examples 1B to 4B

The following evaluation is conducted by using the developers that include toner particles of the combinations shown in Table 2. The following evaluation is conducted in an environment at a temperature of 25° C. and a moisture of 30% RH.

The white developer is put into the fifth engine of a modified machine of Color Press 1000i manufactured by Fuji Xerox Co., Ltd. (a machine modified so as to be able to perform output in a state where a developer is accommodated in at least a single developing machine if no developer is in the other developing machines), the cyan developer is put into the second engine, the magenta developer is put into the third engine, the transparent developer is put into the first engine, and toner images are formed on the FANTAS black paper ((name of product) manufactured by Fujikyowa Seishi; ream weight: 270 kg) such that the white toner, the cyan toner, and the magenta toner are overlaid in this order from the surface of the FANTAS black paper in Examples 1B and 2B and Comparative Examples 1B to 3B and the white toner and the transparent toner are overlaid in this order from the surface of the FANTAS black paper in Example 3B and Comparative Example 4B. The toner applied amount is set to 10 g/m$^2$ for the white toner, 3 g/m$^2$ for the cyan toner, 4 g/m$^2$ for the magenta toner, and 4 g/m$^2$ for the transparent toner.

The toner image is obtained as a solid image having a size of 10 cm×10 cm.

TABLE 1

| | White colored particles | | | | Toner particles | | | Evaluation |
|---|---|---|---|---|---|---|---|---|
| | Type of toner particles | Number average particle diameter (nm) | Proportion of specific particles (% by number) | Type | Lower GSDp | Average circularity | D16p average circularity | Scattering and hiding property |
| Example 1A | (1) | 280 | 18 | Titanium oxide | 1.27 | 0.962 | 0.966 | A |
| Example 2A | (2) | 215 | 20 | Titanium oxide | 1.29 | 0.965 | 0.969 | A |
| Example 3A | (3) | 395 | 23 | Titanium oxide | 1.26 | 0.963 | 0.967 | C |
| Example 4A | (4) | 290 | 7 | Titanium oxide | 1.25 | 0.960 | 0.963 | A |
| Example 5A | (5) | 305 | 47 | Titanium oxide | 1.29 | 0.967 | 0.969 | C |
| Example 6A | (10) | 300 | 21 | Zinc oxide + titanium oxide | 1.26 | 0.962 | 0.967 | A |
| Example 7A | (11) | 280 | 18 | Titanium oxide | 1.26 | 0.961 | 0.963 | A |
| Example 8A | (12) | 280 | 18 | Titanium oxide | 1.35 | 0.963 | 0.965 | B |
| Example 9A | (13) | 280 | 18 | Titanium oxide | 1.29 | 0.951 | 0.956 | B |
| Example 10A | (14) | 280 | 18 | Titanium oxide | 1.31 | 0.975 | 0.978 | B |
| Example 11A | (15) | 280 | 18 | Titanium oxide | 1.26 | 0.961 | 0.963 | C |
| Example 12A | (16) | 280 | 18 | Titanium oxide | 1.34 | 0.966 | 0.969 | B |
| Example 13A | (17) | 280 | 18 | Titanium oxide | 1.28 | 0.962 | 0.967 | A |
| Comparative Example 1A | (6) | 315 | 3 | Titanium oxide | 1.30 | 0.959 | 0.970 | D |
| Comparative Example 2A | (7) | 295 | 56 | Titanium oxide | 1.27 | 0.960 | 0.967 | D |
| Comparative Example 3A | (8) | 190 | 20 | Titanium oxide | 1.26 | 0.965 | 0.969 | D |
| Comparative Example 4A | (9) | 430 | 22 | Titanium oxide | 1.29 | 0.965 | 0.969 | D |

For Examples 1B and 2B and Comparative Examples 1B to 3B, coordinate values (L* values, a* values, and b* values) in a CIE1976 L*a*b* color system are obtained at ten locations in the circumferential part of the toner image (10 mm from, the ends) and ten locations inside the image by using an X-Rite939 (aperture diameter: 4 mm) manufactured by X-Rite Inc. Also, color differences (maximum color differences ΔE) between average values of the L* values, the a* values, and b* values and values at measurement locations where the color differences ΔE becomes maximum are obtained. The color differences ΔE is defined as $\Delta E=((\Delta a)^2+(\Delta b)^2+(\Delta L)^2)^{1/2}$. Smaller maximum color differences ΔE represent more excellent color reproductivity. The obtained results will be shown in Table 2.

Next, a bar chart that is 5 cm wide and 20 cm long in the image output direction is prepared on a FANTAS black sheet with the white toner, 100,000 images are successively output, a blue image (an image in which a cyan toner image and a magenta toner image are overlaid) is provided, and roughness of the fixing members are evaluated based on the following criteria. The obtained results will be shown in Table 2.

Color Reproductivity Evaluation

A: ΔE is equal to or less than 5, and small irregularity in colors is observed.

B: Although ΔE is greater than 5 and equal to or less than 7, and slight irregularity in colors is observed, the irregularity in gloss is in such a level that there is no problem in practical use.

C: ΔE is greater than 7 and equal to or less than 10, and the result is in such a level that there may be a problem depending on methods of use.

D: ΔE is greater than 10, large irregularity in desnsity is observed, and the result is in such a level that there is a problem in a practical use.

Fixing Member Roughness Evaluation

A: No roughness of fixing members is observed.

B: Slight differences in gloss have occurred on the surfaces of the fixing members and are in such a level that there is no problem in practical use.

C: Obvious differences in gloss have occurred in the fixing members, an output image is in such a level that there is no problem.

D: Not only differences in gloss but also cracks are observed in the fixing members, and the fixed image is in such a level that roughness is observed on the surface thereof and irregularity in gloss has occurred.

For Example 3B and Comparative Example 4B, images are slowly inclined and are observed with naked eyes under white light from a white light source in a direction of 60 degrees from the horizontal direction, and glossiness stability is evaluated. The obtained result will be shown in Table 2.

A: Glossiness in the entire image is uniform, and gloss stability is high.

B: Although slight irregularity in gloss is observed depending on location under the white light source, substantially no irregularity in gloss is sensed in an ordinary office environment.

C: Slight irregularity in gloss is noticeable depending on locations under the white light source, slight irregularity in gloss is observed even in the ordinary office environment, and the irregularity in gloss is in such a level that there is no problem in practical use.

D: Irregularity in gloss is significantly observed both under the white light source and in the office environment, and are in a significantly inferior level.

TABLE 2

| | White toner particles | | | | Colored toner particles | | Evaluation | |
|---|---|---|---|---|---|---|---|---|
| | Type of toner particles | Lower GSDp | Average circularity | D16p average circularity | Lower GSDp | Average circularity | Color reproductivity | Roughness of fixing member |
| Example 1B | (1) | 1.27 | 0.962 | 0.966 | 1.21/1.20 | 0.971/0.970 | A | A |
| Example 2B | (5) | 1.29 | 0.967 | 0.969 | 1.21/1.20 | 0.971/0.970 | B | C |
| Comparative Example 1B | (18) | 1.16 | 0.974 | 0.976 | 1.21/1.20 | 0.971/0.970 | D | A |
| Comparative Example 2B | (19) | 1.18 | 0.961 | 0.963 | 1.21/1.20 | 0.971/0.970 | D | A |
| Comparative Example 3B | (14) | 1.31 | 0.975 | 0.978 | 1.21/1.20 | 0.971/0.970 | D | A |

| | White toner particles | | | | Transparent toner particles | | |
|---|---|---|---|---|---|---|---|
| | Type | Lower GSDp | Average circularity | D16p average circularity | Lower GSDp | Average circularity | Evaluation Glossiness stability |
| Example 3B | (1) | 1.27 | 0.962 | 0.966 | 1.18 | 0.972 | A |
| Comparative Example 4B | (18) | 1.16 | 0.974 | 0.976 | 1.18 | 0.972 | D |

As for the lower GSDp and the average circularity of the color toner particles in Table 2, the values in the upper stage are for cyan toner particles, and the values in the lower stage are for magenta toner particles.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner set comprising:

a white toner that includes white toner particles containing white colored particles; and at least one selected from a color toner that includes color toner particles containing colored particles and a transparent toner that includes transparent toner particles, wherein an average circularity of the white toner particles is smaller than an average circularity of either the color toner particles or the transparent toner particles, and wherein a small-diameter-side number particle diameter distribution index of the white toner particles is greater than a small-diameter-side number particle diameter distribution index of either the color toner particles or the transparent toner particles, wherein a ratio between the average circularity of the white toner particles and the average circularity of either the color toner particles or the transparent toner particles ranges from 0.970 to 0.997.

2. The toner set according to claim 1, wherein the small-diameter-side number particle diameter distribution index is calculated as D50p/D16p, where D50p is a particle diameter corresponding to an accumulation of 50% and D16p is a particle diameter corresponding to an accumulation of 16%.

3. The toner set according to claim 1, wherein the average circularity of an observed particle is a number average calculated from circularity of all the particles and circularity is determined by the following equation:

$$\text{circularity}=[2\times(A\times\pi)^{1/2}]/PM, \text{ where}$$

A represents a projection area of the observed particle, and

PM represents a circumferential length of the observed particle.

4. A white toner comprising:

white toner particles that contains white colored particles, wherein a number average particle diameter of the white colored particles is from 200 nm to 400 nm, and wherein a proportion of the white colored particles having a particle diameter of 350 nm to 600 nm with respect to the entire white colored particles is from 5% by number to 50% by number.

5. The white toner according to claim 4, wherein the white colored particles include titanium oxide particles.

6. The white toner according to claim 4, wherein a small-diameter-side number particle diameter distribution index of the white toner particles is from 1.25 to 1.35.

7. The white toner according to claim 4, wherein an average circularity of the white toner particles is from 0.955 to 0.969.

8. The white toner according to claim 4, wherein an average circularity of the white toner particles having a particle diameter falling within a range of from 0.5 μm to a particle diameter corresponding to an accumulation of 16% by number from a small particle diameter side is greater than an average circularity of the entire white toner particles, wherein an average circularity of the white toner particles is from 0.955 to 0.969.

9. The toner set according to claim 8, wherein the small-diameter-side number particle diameter distribution index is calculated as D50p/D16p, where D50p is a particle diameter corresponding to an accumulation of 50% and D16p is a particle diameter corresponding to an accumulation of 16%.

10. The toner set according to claim 8, wherein the average circularity of an observed particle is a number average calculated from circularity of all the particles and circularity is determined by the following equation:

$$\text{circularity}=[2\times(A\times\pi)^{1/2}]/PM, \text{ where}$$

A represents a projection area of the observed particle, and

PM represents a circumferential length of the observed particle.

11. The white toner according to claim 4, wherein the white toner includes polyester resin.

12. The white toner according to claim 4, wherein the white toner includes crystalline polyester resin.

13. The white toner according to claim 4, wherein the white toner includes urea-modified polyester resin.

14. An electrostatic charge image developer comprising:

the white toner according to claim 4.

* * * * *